US009849557B2

(12) United States Patent
Shinozaki

(10) Patent No.: US 9,849,557 B2
(45) Date of Patent: Dec. 26, 2017

(54) COUPLING MECHANISM, SUBSTRATE POLISHING APPARATUS, METHOD OF DETERMINING POSITION OF ROTATIONAL CENTER OF COUPLING MECHANISM, PROGRAM OF DETERMINING POSITION OF ROTATIONAL CENTER OF COUPLING MECHANISM, METHOD OF DETERMINING MAXIMUM PRESSING LOAD OF ROTATING BODY, AND PROGRAM OF DETERMINING MAXIMUM PRESSING LOAD OF ROTATING BODY

(71) Applicant: EBARA CORPORATION, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 71 days.

(21) Appl. No.: 15/007,039

(22) Filed: Jan. 26, 2016

(65) Prior Publication Data

US 2016/0256976 A1 Sep. 8, 2016

(30) Foreign Application Priority Data

Jan. 30, 2015 (JP) ..... 2015-017732
Dec. 21, 2015 (JP) ..... 2015-249121

(51) Int. Cl.
*B24B 37/00* (2012.01)
*B24B 37/005* (2012.01)

(52) U.S. Cl.
CPC ..... *B24B 37/005* (2013.01)

(58) Field of Classification Search
CPC ..... B24N 37/005; Y10T 74/2128; Y10T 403/45–403/459

(Continued)

(56) References Cited

U.S. PATENT DOCUMENTS 1,982,658 A * 12/1934 Griswold ..... F16F 15/1442 74/574.2
2,246,232 A * 6/1941 Almen ..... F16F 15/121 74/574.2

(Continued)

FOREIGN PATENT DOCUMENTS

JP 2000-052230 A 2/2000
JP 2002-509811 A 4/2002

(Continued)

*Primary Examiner* — George Nguyen
(74) *Attorney, Agent, or Firm* — Baker & Hostetler LLP

(57) ABSTRACT

A coupling mechanism which enables a rotating body to follow an undulation of a polishing surface without generating flutter or vibration of the rotating body, and can finely control a load on the rotating body on a polishing surface in a load range which is smaller than the gravity of rotating body is disclosed. The coupling mechanism includes an upper spherical bearing and a lower spherical bearing disposed between a drive shaft and the rotating body. The upper spherical bearing has a first concave contact surface and a second convex contact surface which are in contact with each other, and the lower spherical bearing has a third concave contact surface and a fourth convex contact surface which are in contact with each other. The first concave contact surface and the second convex contact surface are located above the third concave contact surface and the fourth convex contact surface. The first concave contact surface, the second convex contact surface, the third concave contact surface, the fourth convex contact surface are arranged concentrically.

18 Claims, 30 Drawing Sheets

(58) Field of Classification Search
USPC ..... 451/5, 41, 57, 285–290, 443
See application file for complete search history.

(56) References Cited

U.S. PATENT DOCUMENTS 2,249,292 A * 7/1941 Kapitza ..... F16C 23/04 464/137
2,338,470 A * 1/1944 Urquhart ..... H02K 24/00 188/379
2,526,744 A * 10/1950 Hardy ..... F16F 15/1442 74/574.2
2,527,830 A * 10/1950 Lilja ..... F16F 15/129 74/361
3,923,349 A * 12/1975 Herbst ..... F16C 11/0614 384/215
4,194,324 A * 3/1980 Bonora ..... B24B 37/30 269/21
4,313,284 A * 2/1982 Walsh ..... B24B 37/015 451/288
5,738,568 A * 4/1998 Jurjevic ..... B24B 37/30 451/287
6,149,506 A * 11/2000 Duescher ..... B24B 1/00 451/178
6,354,907 B1 * 3/2002 Satoh ..... B24B 37/005 451/10
6,361,423 B2 * 3/2002 Gurusamy ..... B24B 53/017 451/443
6,709,322 B2 * 3/2004 Saldana ..... B24B 37/16 451/285
6,755,723 B1 * 6/2004 Pham ..... B24B 37/30 451/287
6,899,604 B2 * 5/2005 Togawa ..... B24B 41/047 451/443
6,949,016 B1 * 9/2005 de la Llera ..... B24B 21/18 451/285
8,382,558 B2 * 2/2013 Watanabe ..... B24B 53/017 451/288
8,758,088 B2 * 6/2014 Duescher ..... B24B 37/107 451/11
2007/0049166 A1 * 3/2007 Yamaguchi ..... B24B 49/00 451/5
2010/0066040 A1 * 3/2010 Suyama ..... B62D 5/0418 280/5.522
2013/0090038 A1 * 4/2013 Duescher ..... B24B 49/00 451/5
2014/0065931 A1 * 3/2014 Shinozaki ..... B24B 49/18 451/56
2014/0179204 A1 * 6/2014 Shinozaki ..... B24B 53/017 451/443

FOREIGN PATENT DOCUMENTS

JP 2010-172996 A 8/2010
JP 2014-042968 A 3/2014
JP 2014-069299 A 4/2014
WO WO 99/50022 A2 10/1999

* cited by examiner

COUPLING MECHANISM, SUBSTRATE POLISHING APPARATUS, METHOD OF DETERMINING POSITION OF ROTATIONAL CENTER OF COUPLING MECHANISM, PROGRAM OF DETERMINING POSITION OF ROTATIONAL CENTER OF COUPLING MECHANISM, METHOD OF DETERMINING MAXIMUM PRESSING LOAD OF ROTATING BODY, AND PROGRAM OF DETERMINING MAXIMUM PRESSING LOAD OF ROTATING BODY

CROSS REFERENCE TO RELATED APPLICATIONS

This document claims priorities to Japanese Patent Application Number 2015-17732 filed Jan. 30, 2015 and Japanese Patent Application Number 2015-249121 filed Dec. 21, 2015, the entire contents of which are hereby incorporated by reference.

BACKGROUND

With a recent trend toward higher integration and higher density in semiconductor devices, circuit interconnects become finer and finer and the number of levels in multilayer interconnect is increasing. In the process of achieving the multilayer interconnect structure with finer interconnects, film coverage of step geometry (or step coverage) is lowered through thin film formation as the number of interconnect levels increases, because surface steps grow while following surface irregularities on a lower layer. Therefore, in order to fabricate the multilayer interconnect structure, it is necessary to improve the step coverage and planarize the surface in an appropriate process. Further, since finer optical lithography entails shallower depth of focus, it is necessary to planarize surfaces of semiconductor device so that irregularity steps formed thereon fall within a depth of focus in optical lithography.

Accordingly, in a manufacturing process of the semiconductor devices, a planarization technique of a surface of the semiconductor device is becoming more important. The most important technique in this planarization technique is chemical mechanical polishing. This chemical mechanical polishing (which will be hereinafter called CMP) is a process of polishing a substrate, such as a wafer, by placing the substrate in sliding contact with a polishing pad while supplying a polishing liquid containing abrasive grains, such as silica ($SiO_2$), onto the polishing pad.

This chemical mechanical polishing is performed using a CMP apparatus. The CMP apparatus typically includes a polishing table with a polishing pad attached to an upper surface thereof, and a polishing head for holding a substrate, such as a wafer. The polishing table and the polishing head are rotated about their own axes respectively, and in this state the polishing head presses the substrate against a polishing surface (i.e., an upper surface) of the polishing pad, while a polishing liquid is supplied onto the polishing surface, to thereby polish the surface of the substrate. The polishing liquid to be used is typically composed of an alkali solution and fine abrasive grains, such as silica, suspended in the alkali solution. The substrate is polished by a combination of a chemical polishing action by the alkali and a mechanical polishing action by the abrasive grains.

As polishing of the substrate is performed, the abrasive grains and polishing debris adhere to the polishing surface of the polishing pad. In addition, characteristics of the polishing pad change and its polishing performance is lowered. As a result, as polishing of the substrate is repeated, a polishing rate is lowered. Thus, in order to restore the polishing surface of the polishing pad, a dressing apparatus is provided adjacent to the polishing table.

The dressing apparatus typically includes a dresser having a dressing surface which is brought into contact with the polishing pad. The dressing surface is formed by abrasive grains, such as diamond particles. The dressing apparatus is configured to press the dressing surface against the polishing surface of the polishing pad on the rotating polishing table, while rotating the dresser about its own axis, to thereby remove the abrasive grains and the polishing debris deposited on the polishing surface, and to planarize and condition (or dress) the polishing surface.

Each of the polishing head and the dresser is a rotating body that is rotated about its own axis. When the polishing pad is rotated, undulation may occur on the surface (i.e., the polishing surface) of the polishing pad. Thus, in order to enable the rotating body to follow the undulation of the polishing surface, a coupling mechanism that couples the rotating body to a drive shaft through a spherical bearing, is used. Since the coupling mechanism allows the rotating body to be tiltably coupled to the drive shaft, the rotating body can follow the undulation of the polishing surface.

However, when the dresser is pressed against the polishing pad, a relatively large moment due to a frictional force is exerted on the spherical bearing. As a result, the dresser may flutter or vibrate. In particular, as a diameter of a wafer becomes larger up to 450 mm, the flutter or vibration of the dresser is more likely to occur, because a diameter of the dresser also becomes larger. Such flutter or vibration of the dresser inhibits appropriate dressing of the polishing pad. As a result, uniform polishing surface cannot be obtained.

Japanese Laid-Open Patent Publication No. 2002-509811 discloses a conditioner head including a drive sleeve to which a hub is fixed, a backing plate connected to a body of a disk holder for holding a conditioning disk, and a plurality of sheet-like spokes that couple the hub and the backing plate to each other. The hub has a concave spherical portion, and the backing plate has a convex spherical portion with a radius equal to a radius of the concave spherical portion of the hub. The convex spherical portion is capable of being in sliding engagement with the concave spherical portion of the hub. The concave spherical portion of the hub and the convex spherical portion of the backing plate constitute a spherical bearing.

In the conditioner head disclosed in Japanese Laid-Open Patent Publication No. 2002-509811, the conditioning disk, the disk holder, and the backing plate are coupled to the drive sleeve through the sheet-like spokes which serve as a plate spring. Therefore, when the sheet-like spokes are plastically deformed, the conditioning disk cannot flexibly follow the polishing surface of the polishing pad. In particular, when the conditioner head is elevated, the conditioning disk, the disk holder, and the backing plate hang down from the sheet-like spokes, thus possibly causing the plastic deformation of the sheet-like spokes. Further, when the conditioner head is elevated, the concave spherical portion of the hub is separated from the convex spherical portion of the backing plate. As a result, a dressing load cannot be applied to the polishing surface, unless a load, which is larger than a total weight of the conditioning disk, the disk holder, and the backing plate, is applied to the conditioner head. Since dressing of the polishing surface cannot be performed within a low load range, a fine dressing-control cannot be performed.

SUMMARY OF THE INVENTION

According to an embodiment, there is provided a coupling mechanism which enables a rotating body to follow an undulation of a polishing surface without causing flutter or vibration of the rotating body, and can finely control a load of the rotating body on a polishing surface within a load range which is smaller than the gravity of the rotating body. Further, there is provided a substrate polishing apparatus in which the coupling mechanism is incorporated. Further, according to an embodiment, there are provided a method of determining a position of a rotational center of the coupling mechanism, and a program of determining a position of a rotational center, which can determine a position of a rotational center of the coupling mechanism that does not cause flutter or vibration of the rotating body. Further, according to an embodiment, there are provided a method of determining a maximum pressing load of the rotating body and a program of determining a maximum pressing load of the rotating body that does not cause flutter or vibration of the rotating body.

Embodiments, which will be described below, relate to a coupling mechanism for coupling a rotating body, such as a polishing head and a dresser, to a drive shaft, and relate to a substrate polishing apparatus in which the coupling mechanism is incorporated. Further, embodiments, which will be described below, relate to a method of determining a position of a rotational center of the coupling mechanism, and a program of determining a position of a rotational center of the coupling mechanism. Further, embodiments, which will be described below, relate to a method of determining a maximum pressing load of the rotating body, and a program of determining a maximum pressing load of the rotating body.

In an embodiment, there is provided a coupling mechanism for tiltably coupling a rotating body to a drive shaft, comprising: an upper spherical bearing and a lower spherical bearing disposed between the drive shaft and the rotating body, wherein the upper spherical bearing includes a first sliding-contact member and a second sliding-contact member which are sandwiched between the drive shaft and the rotating body, the first sliding-contact member has a first concave contact surface, and the second sliding-contact member has a second convex contact surface which is in contact with the first concave contact surface, the lower spherical bearing includes a third sliding-contact member attached to the drive shaft, and a fourth sliding-contact member attached to the rotating body, the third sliding-contact member has a third concave contact surface, and the fourth sliding-contact member has a fourth convex contact surface which is in contact with the third concave contact surface, the first concave contact surface and the second convex contact surface are located above the third concave contact surface and the fourth convex contact surface, and the first concave contact surface, the second convex contact surface, the third concave contact surface, and the fourth convex contact surface are arranged concentrically.

In an embodiment, each of the first concave contact surface and the second convex contact surface has a shape of a part of an upper half of a spherical surface having a first radius, and each of the third concave contact surface and the fourth convex contact surface has a shape of a part of an upper half of a spherical surface having a second radius which is smaller than the first radius.

In an embodiment, the upper spherical bearing and the lower spherical bearing have a same rotational center, and the rotational center is located below the first concave contact surface, the second convex contact surface, the third concave contact surface, and the fourth convex contact surface.

In an embodiment, a distance from a bottom end surface of the rotating body to the rotational center can be changed by selecting radii of curvature of the first concave contact surface, the second convex contact surface, the third concave contact surface, and the fourth convex contact surface.

In an embodiment, the rotational center is located on a bottom end surface of the rotating body.

In an embodiment, the rotational center coincides with a center of inertia of a displacement portion which can tilt about the rotational center.

In an embodiment, the rotational center is located between a bottom end surface of the rotating body and a center of inertia of a displacement portion which can tilt about the rotational center.

In an embodiment, the rotational center is located below a bottom end surface of the rotating body.

In an embodiment, one of the first sliding-contact member and the second sliding-contact member has a Young's modulus which is equal to or lower than a Young's modulus of the other, or has a damping coefficient which is higher than a damping coefficient of the other.

In an embodiment, there is provided a coupling mechanism for tiltably coupling a rotating body to a drive shaft, comprising: a damping member disposed between the drive shaft and the rotating body, wherein the damping member is attached to both a lower end of the drive shaft and the rotating body, and the damping member has a Young's modulus which is equal to or lower than a Young's modulus of the drive shaft, or has a damping coefficient which is higher than a damping coefficient of the drive shaft.

In an embodiment, the damping member has the Young's modulus in a range of 0.1 GPa to 210 GPa, or has the damping coefficient such that a damping ratio is in a range of 0.1 to 0.8.

In an embodiment, the damping member is a rubber bush.

In an embodiment, the damping member is a damping ring in an annular shape.

In an embodiment, there is provided a substrate polishing apparatus comprising: a polishing table for supporting a polishing pad; and a polishing head configured to press a substrate against the polishing pad, wherein the polishing head is coupled to a drive shaft through the above-described coupling mechanism.

In an embodiment, there is provided a substrate polishing apparatus comprising: a polishing table for supporting a polishing pad; a polishing head configured to press a substrate against the polishing pad; and a dresser which is pressed against the polishing pad, wherein the dresser is coupled to a drive shaft through the above-described coupling mechanism.

In an embodiment, the substrate polishing apparatus further comprises a pad-height measuring device configured to measure a height of a polishing surface of the polishing pad, wherein the pad-height measuring device includes: a pad-height sensor secured to a dresser arm which rotatably supports the drive shaft; and a sensor target secured to the drive shaft.

In an embodiment, there is provided a method of determining a position of a rotational center of a coupling mechanism which includes an upper spherical bearing and a lower spherical bearing having a same rotational center and tiltably couples a rotating body to a drive shaft, comprising: specifying an equation of motion for a tilting motion of a displacement portion which can tilt about the rotational center when the rotating body is in sliding contact with a polishing pad supported by a rotating polishing table, while rotating the rotating body; specifying a stability condition expression for the tilting motion for preventing flutter or vibration of the rotating body, based on the equation of motion for the tilting motion; calculating a range of a position of the rotational center for preventing the flutter or vibration of the rotating body, based on the stability condition expression for the tilting motion; and determining the position of the rotational center which falls within the calculated range.

In an embodiment, said determining comprises, if a center of inertia of the displacement portion falls within the calculated range, determining the position of the rotational center which coincides with the center of inertia.

In an embodiment, there is provided a program of determining a position of a rotational center of a coupling mechanism which includes an upper spherical bearing and a lower spherical bearing having a same rotational center and tiltably couples a rotating body to a drive shaft, the program causing a computer to perform operations of: calculating a range of the position of the rotational center for preventing flutter or vibration of the rotating body, from a stability condition expression for a tilting motion, which is specified based on an equation of motion for the tilting motion of a displacement portion which can tilt about the rotational center when the rotating body is in sliding contact with a polishing pad supported by a rotating polishing table, while rotating the rotating body; and determining the position of the rotational center which falls within the calculated range.

In an embodiment, causing the computer to perform an operation of said determining comprises causing the computer to perform an operation of, if a center of inertia of the displacement portion falls within the calculated range, determining the position of the rotational center which coincides with the center of inertia.

In an embodiment, there is provided a method of determining a maximum pressing force of a rotating body which is tiltably coupled to a drive shaft through a coupling mechanism which includes an upper spherical bearing and a lower spherical bearing having a same rotational center, comprising: specifying an equation of motion for a translational motion and an equation of motion for a tilting motion of a displacement portion which can tilt about the rotational center when the rotating body is in sliding contact with a polishing pad supported by a rotating polishing table, while rotating the rotating body; specifying a stability condition expression for the translational motion for preventing flutter or vibration of the rotating body, based on the equation of motion for the translational motion; specifying a stability condition expression for the tilting motion for preventing flutter or vibration of the rotating body, based on the equation of motion for the tilting motion; calculating a critical value of a pressing load in the translational motion, based on the stability condition expression for the translational motion; calculating a critical value of a pressing load in the tilting motion, based on the stability condition expression for the tilting motion; comparing the critical value of the pressing load in the translational motion with the critical value of the pressing load in the tilting motion; if the critical value of the pressing load in the translational motion is smaller than or equal to the critical value of the pressing load in the tilting motion, determining that the critical value of the pressing load in the translational motion is the maximum pressing load of the rotating body; and if the critical value of the pressing load in the translational motion is larger than the critical value of the pressing load in the tilting motion, determining that the critical value of the pressing load in the tilting motion is the maximum pressing load of the rotating body.

In an embodiment, there is provided a program of determining a maximum pressing load of a rotating body which is tiltably coupled to a drive shaft through a coupling mechanism which includes an upper spherical bearing and a lower spherical bearing having a same rotational center, the program causing a computer to perform operations of: calculating a critical value of a pressing load in a translational motion, which can prevent flutter or vibration of the rotating body, from a stability condition expression for the translational motion which is specified based on an equation of motion for the translational motion of a displacement portion which can tilt about the rotational center when the rotating body is in sliding contact with a polishing pad supported by a rotating polishing table, while rotating the rotating body; calculating a critical value of a pressing load in a tilting motion, which can prevent flutter or vibration of the rotating body, from a stability condition expression for the tilting motion which is specified based on an equation of motion for the tilting motion of the displacement portion when the rotating body is in sliding contact with the polishing pad supported by the rotating polishing table, while rotating the rotating body; comparing the critical value of the pressing load in the translational motion with the critical value of the pressing load in the tilting motion; if the critical value of the pressing load in the translational motion is smaller than or equal to the critical value of the pressing load in the tilting motion, determining that the critical value of the pressing load in the translational motion is the maximum pressing load of the rotating body; and if the critical value of the pressing load in the translational motion is larger than the critical value of the pressing load in the tilting motion, determining that the critical value of the pressing load in the tilting motion is the maximum pressing load of the rotating body.

According to the abode-described embodiments, the upper spherical bearing and the lower spherical bearing can receive a force in a radial direction which is applied to the rotating body, while these spherical bearings can continuously receive a force in an axial direction (i.e., in a direction perpendicular to the radial direction) which may cause the rotating body to vibrate. Further, the upper spherical bearing and the lower spherical bearing can exert a sliding force against a moment which is generated around the rotating center due to a frictional force generated between the rotating body and the polishing pad, while receiving the radial force and the axial force. As a result, the upper spherical bearing and the lower spherical bearing can prevent the flutter and the vibration of the rotating body. In particular, when the rotational center is located on the bottom end surface of the rotating body or near the bottom end surface of the rotating body, the moment due to the frictional force generated between the rotating body and the polishing pad is hardly generated. As a result, the flutter or vibration of the rotating body can be prevented more effectively. Further, when the rotating body is elevated, the rotating body is supported by the upper spherical bearing. As a result, a dressing load on the polishing surface can be finely controlled in a load range which is smaller than the gravity of rotating body.

According to the above-described embodiments, when the undulation occurs on the polishing surface of the rotating polishing pad, the damping member appropriately deforms, whereby the rotating body can appropriately follow the undulation of the polishing surface. Further, since the rotating body is secured to the drive shaft through the damping member, a vibration resistance of the rotating body can be improved. More specifically, vibration of the rotating body due to a frictional force produced when the rotating body is in sliding contact with the polishing surface can be damped by the damping member. As a result, the flutter or vibration of the rotating body can be inhibited. Further, since the rotating body is secured to the damping member which is secured to the drive shaft, a load on the polishing surface can be finely controlled in a load range which is smaller than the gravity of rotating body.

According to the above-described embodiments, the rotating body is a polishing head or a dresser. The polishing head or the dresser can flexibly tilt in response to the undulation of the polishing surface of the rotating polishing pad, because the polishing head or the dresser is coupled to the drive shaft through the above-mentioned coupling mechanism. In addition, the flutter or vibration of the polishing head or the dresser can be prevented. Further, the load on the polishing surface can be finely controlled in a load range which is smaller than the gravity of the polishing head or the dresser. As a result, a fine polishing-control or a fine dressing-control can be performed.

According to the above-described embodiments, the position of the rotational center of the coupling mechanism that does not cause the flutter or vibration of the rotating body can be determined from the stability condition expression for the tilting motion that is specified based on the equation of motion for the tilting motion of the displacement portion.

According to the above-described embodiments, the maximum pressing load of the rotating body that does not cause the flutter or vibration of the rotating body can be determined from the stability condition expression for the translational motion that is specified based on the equation of motion for the translational motion of the displacement portion, and from the stability condition expression for the tilting motion that is specified based on the equation of motion for the tilting motion of the displacement portion.

DESCRIPTION OF EMBODIMENTS

Embodiments will be described below with reference to the drawings.

Figure 1:
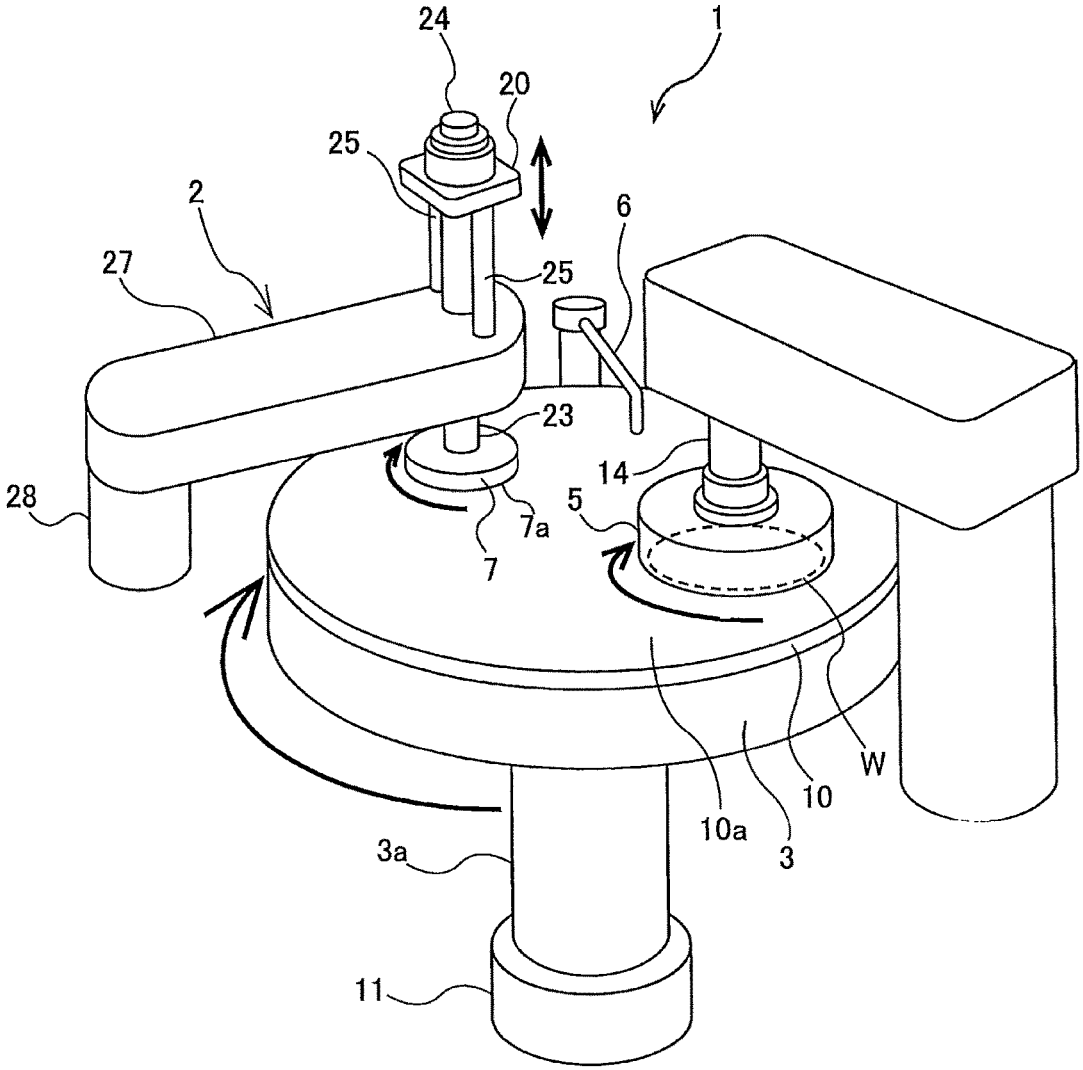
FIG. 1 is a perspective view schematically showing a substrate polishing apparatus.

FIG. 1 is a perspective view schematically showing a substrate polishing apparatus 1. This substrate polishing apparatus 1 includes a polishing table 3 to which a polishing pad 10, having a polishing surface 10*a*, is attached, a polishing head 5 for holding a substrate W, such as a wafer, and pressing the substrate W against the polishing pad 10 on the polishing table 3, a polishing liquid supply nozzle 6 for supplying a polishing liquid and a dressing liquid (e.g., pure water) onto the polishing pad 10, and a dressing apparatus 2 having a dresser 7 for dressing the polishing surface 10*a* of the polishing pad 10.

The polishing table 3 is coupled to a table motor 11 through a table shaft 3*a*, so that the polishing table 3 is rotated by this table motor 11 in a direction indicated by arrow. The table motor 11 is located below the polishing table 3. The polishing pad 10 is attached to an upper surface of the polishing table 3. The polishing pad 10 has an upper surface, which provides the polishing surface 10*a* for polishing the wafer. The polishing head 5 is coupled to a lower end of a head shaft 14. The polishing head 5 is configured to be able to hold the wafer on its lower surface by vacuum suction. The head shaft 14 is elevated and lowered by an elevating mechanism (not shown).

Polishing of the wafer W is performed as follows. The polishing head 5 and the polishing table 3 are rotated in directions as indicated by arrows, respectively, and the polishing liquid (or slurry) is supplied onto the polishing pad 10 from the polishing liquid supply nozzle 6. In this state, the polishing head 5 presses the wafer W against the polishing surface 10*a* of the polishing pad 10. The surface of the wafer W is polished by a mechanical action of abrasive grains contained in the polishing liquid and a chemical action of the polishing liquid. After polishing of the wafer W, dressing (or conditioning) of the polishing surface 10*a* is performed by the dresser 7.

A dressing apparatus 2 includes a dresser 7 which is brought into sliding contact with the polishing pad 10, a dresser shaft 23 to which the dresser 7 is coupled, a pneumatic cylinder 24 mounted to an upper end of the dresser shaft 23, and a dresser arm 27 for rotatably supporting the dresser shaft 23. A lower surface of the dresser 7 serves as a dressing surface 7*a*, and this dressing surface 7*a* is formed by abrasive grains (e.g., diamond particles). The pneumatic cylinder 24 is disposed on a support base 20 which is supported by a plurality of columns 25, which are fixed to the dresser arm 27.

The dresser arm 27 is actuated by a motor (not shown) to pivot on a pivot shaft 28. The dresser shaft 23 is rotated about its own axis by an actuation of a motor (not shown), thus rotating the dresser 7 about the dresser shaft 23 in a direction indicated by arrow. The pneumatic cylinder 24 serves as an actuator for moving the dresser 7 vertically through the dresser shaft 23 and for pressing the dresser 7 against the polishing surface (front surface) 10*a* of the polishing pad 10 at a predetermined pressing force.

Dressing of the polishing pad 10 is performed as follows. The pure water is supplied from the polishing liquid supplying nozzle 6 onto the polishing pad 10, while the dresser 7 is rotated about the dresser shaft 23. In this state, the dresser 7 is pressed against the polishing pad 10 by the pneumatic cylinder 24 to place the dressing surface 7*a* in sliding contact with the polishing surface 10*a* of the polishing pad 10. Further, the dresser arm 27 pivots around the pivot shaft 28 to cause the dresser 7 to oscillate in a radial direction of the polishing pad 10. In this manner, the dresser 7 scrapes the polishing pad 10 to thereby dress (or restore) the surface 10*a* of the polishing pad 10.

The aforementioned head shaft 14 is a drive shaft which is rotatable and vertically movable, and the aforementioned polishing head 5 is a rotating body which rotates about its own axis. Similarly, the aforementioned dresser shaft 23 is a drive shaft which is rotatable and vertically movable, and the dresser 7 is a rotating body which rotates about its own axis. These rotating bodies 5, 7 are coupled to the drive shafts 14, 23 through coupling mechanisms, respectively, which will be described below, so as to be tiltable with respect to the drive shafts 14, 23.

Figure 2:
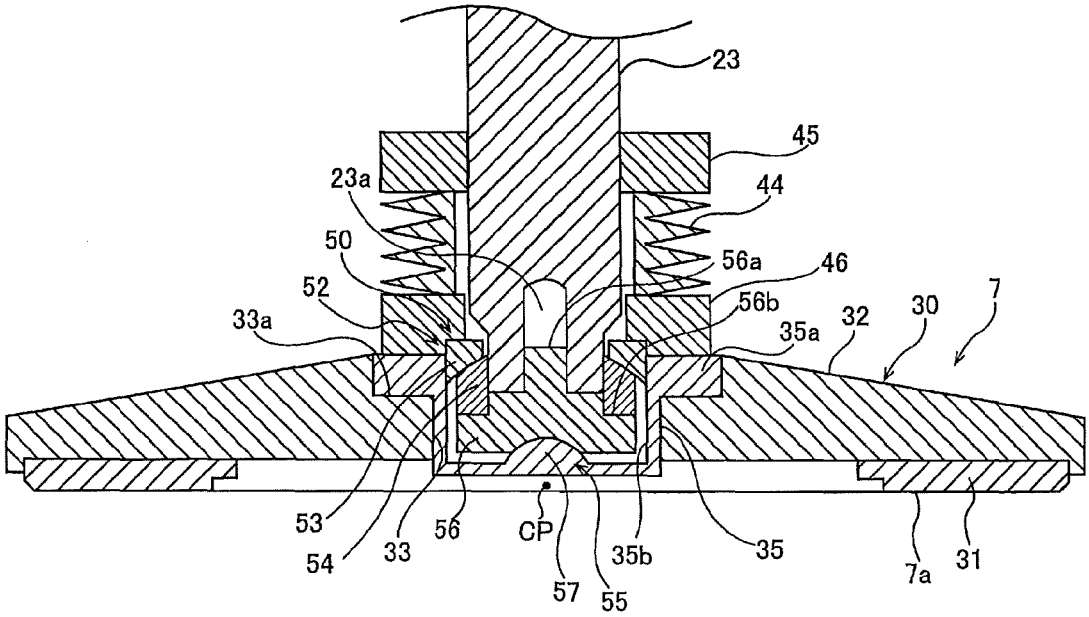
FIG. 2 is a schematic cross-sectional view showing a dresser which is supported by a coupling mechanism according to an embodiment.

FIG. 2 is a schematic cross-sectional view showing the dresser (rotating body) 7 which is supported by the coupling mechanism according to an embodiment. As shown in FIG. 2, the dresser 7 of the dressing apparatus 2 includes a circular disk holder 30, and an annular dresser disk 31 which is fixed to a lower surface of the disk holder 30. The disk holder 30 is composed of a holder body 32 and a sleeve 35. A lower surface of the dresser disk 31 serves as the aforementioned dressing surface 7*a*.

A hole 33 having a stepped portion 33*a* is formed in the holder body 32 of the disk holder 30, and a central axis of this hole 33 is aligned with a central axis of the dresser 7 which is rotated by the dresser shaft (drive shaft) 23. The hole 33 extends in a vertical direction through the holder body 32.

The sleeve 35 is fitted into the hole 33 of the holder body 32. A sleeve flange 35*a* is formed at an upper portion of the sleeve 35, and this sleeve flange 35*a* is fitted into the stepped portion 33*a* of the hole 33. In this state, the sleeve 35 is fixedly mounted to the holder body 32 by a fixing member (not shown), such as a screw. The sleeve 35 has an insertion recess 35*b* which opens upwardly. An upper spherical bearing 52 and a lower spherical bearing 55 of a coupling mechanism (gimbal mechanism) 50, which will be described later, are disposed in the insertion recess 35*b*.

A bellows 44, which couples the dresser shaft 23 to the dresser 7, is provided. More specifically, an upper cylindrical portion 45 connected to an upper portion of the bellows 44 is secured to an outer circumferential surface of the dresser shaft 23, and a lower cylindrical portion 46 connected to a lower portion of the bellows 44 is secured to an upper surface of the sleeve 35 of the dresser 7. The bellows 44 is configured to transmit a torque of the dresser shaft 23 to the disk holder 30 (i.e., to the dresser 7), while allowing the dresser 7 to tilt with respect to the dresser shaft 23.

In order to enable the dresser 7 to follow an undulation of the polishing surface 10*a* of the rotating polishing pad 10, the disk holder 30 of the dresser (rotating body) 7 is coupled to the dresser shaft (drive shaft) 23 through the coupling mechanism (gimbal mechanism) 50. The coupling mechanism 50 will be described below.

Figure 3:
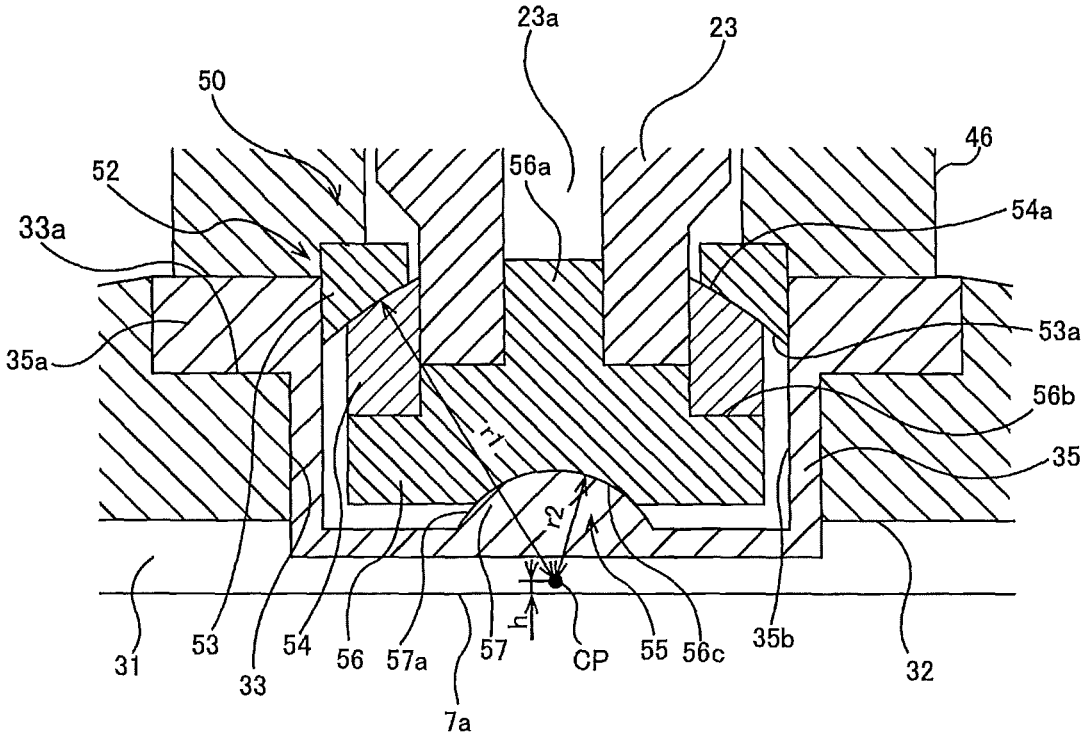
FIG. 3 is an enlarged view of the coupling mechanism shown in FIG. 2.

FIG. 3 is an enlarged view of the coupling mechanism 50 shown in FIG. 2. The coupling mechanism 50 includes the upper spherical bearing 52 and the lower spherical bearing 55 which are separated from each other in a vertical direction. These upper spherical bearing 52 and lower spherical bearing 55 are disposed between the dresser shaft 23 and the dresser 7.

The upper spherical bearing 52 includes an annular first sliding-contact member 53 having a first concave contact surface 53*a*, and an annular second sliding-contact member 54 having a second convex contact surface 54*a* which is in contact with the first concave contact surface 53*a*. The first sliding-contact member 53 and the second sliding-contact member 54 are sandwiched between the dresser shaft 23 and the dresser 7. More specifically, the first sliding-contact member 53 is inserted into the insertion recess 35*b* of the sleeve 35, and is further sandwiched between the second sliding-contact member 54 and the lower cylindrical portion 46 connected to the lower portion of the bellows 44. A lower end of the dresser shaft 23 is inserted into the annular second sliding-contact member 54. Further, the second sliding-contact member 54 is sandwiched between a third sliding-contact member 56, which will be described later, and the first sliding-contact member 53. Each of the first concave contact surface 53*a* of the first sliding-contact member 53 and the second convex contact surface 54*a* of the second sliding-contact member 54 has a shape of a part of an upper half of a spherical surface having a first radius r1. Accordingly, these two first concave contact surface 53*a* and second convex contact surface 54*a* have the same radius of curvature (which is equal to the aforementioned first radius r1), and slidably engage with one another.

The lower spherical bearing 55 includes the third sliding-contact member 56 having a third concave contact surface 56*c*, and a fourth sliding-contact member 57 having a fourth convex contact surface 57*a* which is in contact with the third concave contact surface 56*c*. The third sliding-contact member 56 is attached to the dresser shaft 23. More specifically, a threaded hole 23*a*, which upwardly extends from the lower end of the dresser shaft 23, is formed in the dresser shaft 23. The third sliding-contact member 56 has a screw portion 56*a* formed at an upper portion thereof. The screw portion 56*a* is screwed into the threaded hole 23*a*, so that the third sliding-contact member 56 is fixed to the dresser shaft 23, and the first sliding-contact member 53 and the second sliding-contact member 54 are pressed against the lower cylindrical portion 46.

The second sliding-contact member 54 of the upper spherical bearing 52 is sandwiched between the first sliding-contact member 53 and the third sliding-contact member 56. More specifically, the second sliding-contact member 54 is sandwiched between an annular stepped portion 56*b*, formed at an upper portion of the third sliding-contact member 56, and the first concave contact surface 53*a* of the first sliding-contact member 53. The fourth sliding-contact member 57 is attached to the dresser 7. In this embodiment, the fourth sliding-contact member 57 is provided on a bottom surface of the sleeve 35 of the dresser 7, and the fourth sliding-contact member 57 is integral with the sleeve 35. The fourth sliding-contact member 57 may be constituted as another member that is different from the sleeve 35.

Each of the third concave contact surface 56*c* of the third sliding-contact member 56 and the fourth convex contact surface 57*a* of the fourth sliding-contact member 57 has a shape of a part of an upper half of a spherical surface having a second radius r2 which is smaller than the aforementioned first radius r1. Thus, these two third concave contact surface 56*c* and fourth convex contact surface 57*a* have the same radius of curvature (which is equal to the aforementioned second radius r2), and slidably engage with one another. A pressing force generated by the pneumatic cylinder 24 (see FIG. 1) is transmitted to the dresser 7 through the dresser shaft 23 and the lower spherical bearing 55.

The upper spherical bearing 52 and the lower spherical bearing 55 have different radii of rotation, while having the same rotational center CP. More specifically, the first concave contact surface 53*a*, the second convex contact surface 54*a*, the third concave contact surface 56*c*, and the fourth convex contact surface 57*a* are concentric, and their centers of curvature coincide with the rotational center CP. This rotational center CP is located below the first concave contact surface 53*a*, the second convex contact surface 54*a*, the third concave contact surface 56*c*, and the fourth convex contact surface 57*a*. More specifically, the rotational center CP is located on a bottom end surface (i.e., the dressing surface 7*a*) of the dresser 7, or near the bottom end surface of the dresser 7. In the embodiment shown in FIG. 2, the rotational center CP is located at a position higher than the bottom end surface of the dresser 7 by 1 mm. Specifically, as shown in FIG. 3, a distance h from the bottom end surface of the dresser 7 to the rotational center CP is 1 mm. This distance h may be 0 mm (i.e., the rotational center CP is located on the bottom end surface of the dresser 7), or may be a negative value (i.e., the rotational center CP is located below the bottom end surface of the dresser 7). By appropriately selecting the radii of curvature of the first concave contact surface 53*a*, the second convex contact surface 54*a*, the third concave contact surface 56*c*, and the fourth convex contact surface 57*a* which have the same rotational center CP, the distance h from the bottom end surface of the dresser 7 to the rotational center CP can be changed. As a result, a desired distance h can be obtained. In order to locate the rotational center CP on the bottom end surface of the dresser 7, or near the bottom end surface, the upper spherical bearing 52 and the lower spherical bearing 55 are disposed in the insertion recess 35*b* of the sleeve 35 which is inserted and fitted into the hole 33 formed in the holder body 32. Wear particles, which are produced from the upper spherical bearing 52 and the lower spherical bearing 55, are received by the sleeve 35. Therefore, the sleeve 35 can prevent the wear particles from falling down onto the polishing pad 10.

The first concave contact surface 53*a* and the second convex contact surface 54*a* of the upper spherical bearing 52 is located above the third concave contact surface 56*c* and the fourth convex contact surface 57*a* of the lower spherical bearing 55. The dresser 7 is tiltably coupled to the dresser shaft 23 through the two spherical bearings, i.e., the upper spherical bearing 52 and the lower spherical bearing 55. Since the upper spherical bearing 52 and the lower spherical bearing 55 have the same rotational center CP, the dresser 7 can flexibly tilt in response to the undulation of the polishing surface 10*a* of the rotating polishing pad 10.

The upper spherical bearing 52 and the lower spherical bearing 55 can receive a force in a radial direction which is applied to the dresser 7, while the spherical bearings 52, 55 can continuously receive a force in an axial direction (i.e., in a direction perpendicular to the radial direction) which may cause the dresser 7 to vibrate. Further, the upper spherical bearing 52 and the lower spherical bearing 55 can exert a sliding force against a moment which is generated around the rotating center CP due to a frictional force generated between the dresser 7 and the polishing pad 10, while receiving the radial force and the axial force. As a result, the upper spherical bearing 52 and the lower spherical bearing 55 can prevent the flutter and the vibration of the dresser 7. In this embodiment, the moment due to the frictional force generated between the dresser 7 and the polishing pad 10 is hardly generated, because the rotational center CP is located on the bottom end surface of the dresser 7, or near the bottom end surface of the dresser 7. This moment is 0 when the distance h from the bottom end surface of the dresser 7 to the rotational center CP is 0. As a result, the flutter or vibration of the dresser 7 can be prevented more effectively. Further, when the dresser 7 is elevated, the dresser 7 is supported by the upper spherical bearing 52. As a result, a dressing load on the polishing surface 10*a* can be finely controlled in a load range which is smaller than the gravity of dresser 7. Therefore, a fine dressing control can be performed.

Figure 4:
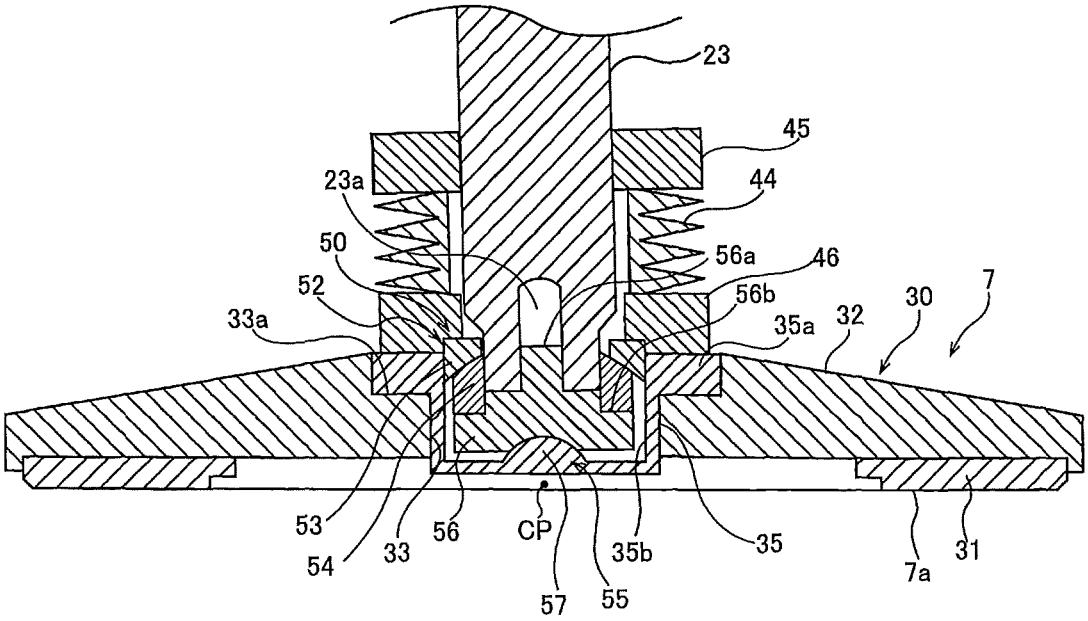
FIG. 4 is a schematic cross-sectional view showing a state in which the dresser, supported by the coupling mechanism shown in FIG. 2, tilts.

FIG. 4 is a schematic cross-sectional view showing a state in which the dresser 7, supported by the coupling mechanism shown in FIG. 2, tilts. As shown in FIG. 4, the upper spherical bearing 52 and the lower spherical bearing 55 allows the dresser 7 to tilt in accordance with the undulation of the polishing surface 10*a*. When the dresser 7 tilts, the bellows 44, which couples the dresser shaft 23 and the dresser 7 to each other, deforms in accordance with the tilting motion of the dresser 7. Therefore, the dresser 7 can tilt, while receiving the torque of the dresser shaft 23 which is transmitted through the bellows 44.

Figure 5:
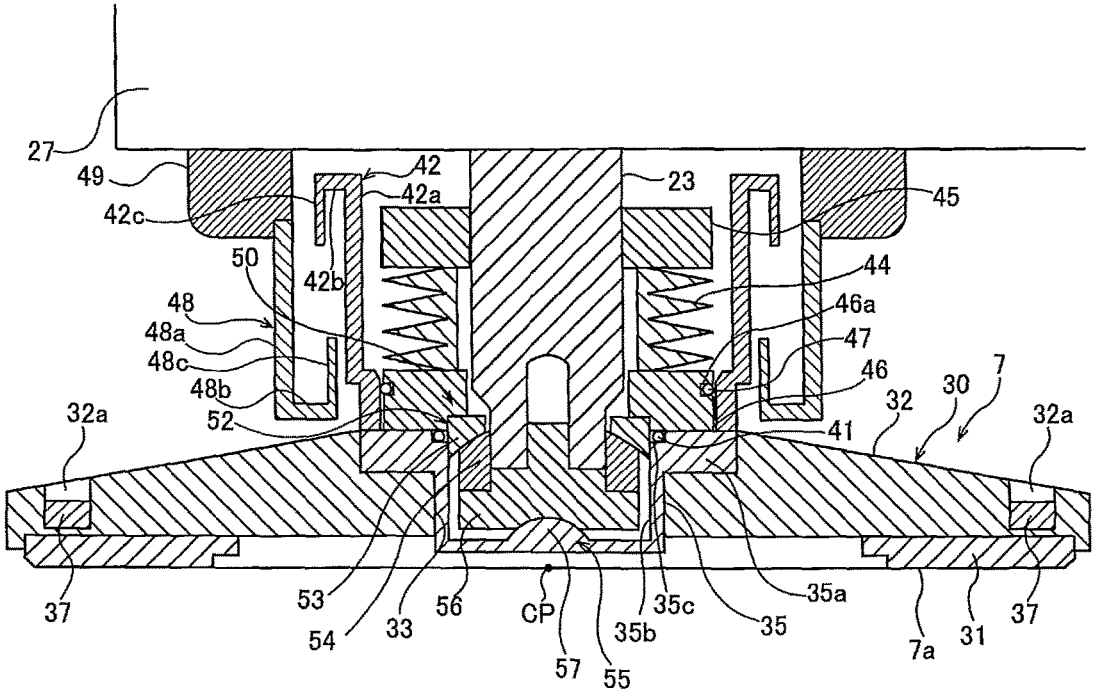
FIG. 5 is a cross-sectional view showing another embodiment of the coupling mechanism.

FIG. 5 is a cross-sectional view showing another embodiment of the coupling mechanism 50. Structures of this embodiment, which will not be described particularly, are identical to those of the coupling mechanism 50 shown in FIG. 2. In this embodiment, the rotational center CP of the upper spherical bearing 52 and the lower spherical bearing 55 is located on the bottom end surface of the dresser 7 (i.e., the distance h=0). The dresser disk 31 of the dresser 7 shown in FIG. 5 is made of a magnetic material. The dresser disk 31 is secured to the holder body 32 by magnets 37, which are disposed in a plurality of recesses 32*a*, respectively. These recesses 32*a* are formed in an upper surface of the holder body 32. The recesses 32*a* and the magnets 37 are arranged at equal intervals along a circumferential direction of the holder body 32.

An annular groove 35*c* is formed in an upper surface of the sleeve 35 (i.e., an upper surface of the sleeve flange 35*a*), and an O-ring 41 extending around the coupling mechanism 50 is disposed in this annular groove 35*c*. The O-ring 41 seals a gap between the sleeve 35 and the lower cylindrical member 46.

A first cylindrical cover 42 having a base portion 42*a* is provided. The base portion 42*a* extends upwardly and is separated slightly away from an outer circumferential surface of the lower cylindrical portion 46. The first cylindrical cover 42 has the base portion 42*a* extending upwardly from the upper surface of the sleeve 35, an annular horizontal portion 42*b* extending outwardly in a horizontal direction from the upper end of the base portion 42*a*, and a folded portion 42*c* extending downwardly from an outer circumferential end of the horizontal portion 42*b*. Each of the base portion 42*a* and the folded portion 42*c* of the first cylindrical cover 42 has a cylindrical shape, and the horizontal portion 42*b* extends horizontally around an entire circumference of the base portion 42*a*. An annular groove 46*a* is formed in the outer circumferential surface of the lower cylindrical portion 46, and an O-ring 47 is disposed in the annular groove 46*a*. The O-ring 47 seals a gap between the outer circumferential surface of the lower cylindrical portion 46 and an inner circumferential surface of the base portion 42*a* of the first cylindrical cover 42.

A second cylindrical cover 48 is secured to the dresser arm 27 which rotatably supports the dresser shaft 23. The second cylindrical cover 48 has a base portion 48*a* extending downwardly from a bottom end surface of the dresser arm 27, an annular horizontal portion 48*b* extending horizontally inwardly from a lower end of the base portion 48*a*, and a folded portion 48*c* extending upwardly from an inner circumferential end of the horizontal portion 48*b*. Each of the base portion 48*a* and the folded portion 48*c* of the second cylindrical cover 48 has a cylindrical shape. The horizontal portion 48*b* extends horizontally around an entire circumference of the base portion 48*a*. The base portion 48*a* of the second cylindrical cover 48 surrounds the base portion 42*a* of the first cylindrical cover 42. The folded portion 48*c* of the second cylindrical portion 48 is located more inwardly than the folded portion 42*c* of the first cylindrical cover 42. The first cylindrical cover 42 and the second cylindrical cover 48 constitute a labyrinth structure. Although now shown in the drawings, a lower end of the folded portion 42*c* of the first cylindrical cover 42 may be located below an upper end of the folded portion 48*c* of the second cylindrical cover 48.

The O-ring 41, the O-ring 47, and the labyrinth structure constituted by the first cylindrical cover 42 and the second cylindrical cover 48 prevent the wear particles, which are produced from the upper spherical bearing 52 and the lower spherical bearing 55, from spreading out of the dresser 7. Similarly, the O-ring 41, the O-ring 47, and the labyrinth structure constituted by the first cylindrical cover 42 and the second cylindrical cover 48 prevent the dressing liquid, which has been supplied onto the dresser 7, from reaching the upper spherical bearing 52 and the lower spherical bearing 55.

Figure 6:
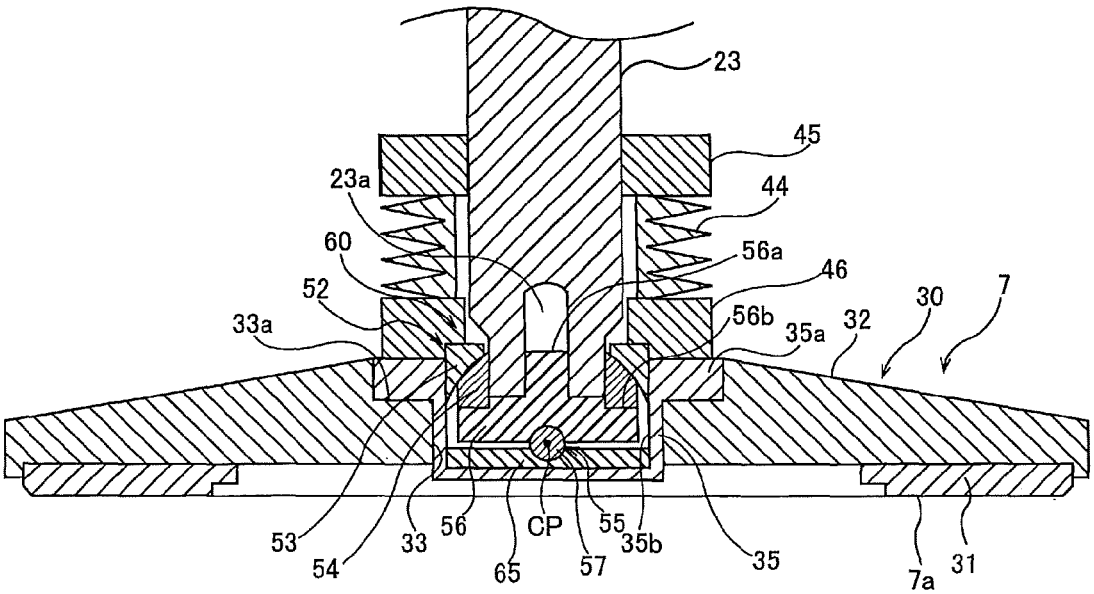
FIG. 6 is a schematic cross-sectional view showing still another embodiment of the coupling mechanism.

FIG. 6 is a schematic cross-sectional view showing still another embodiment of the coupling mechanism. Structures of this embodiment, which will not be described particularly, are identical to those of the above-described embodiments, and repetitive descriptions thereof are omitted. A coupling mechanism 60 shown in FIG. 6 constitutes a gimbal mechanism for tiltably coupling the dresser 7 to the dresser shaft 23.

Figure 7:
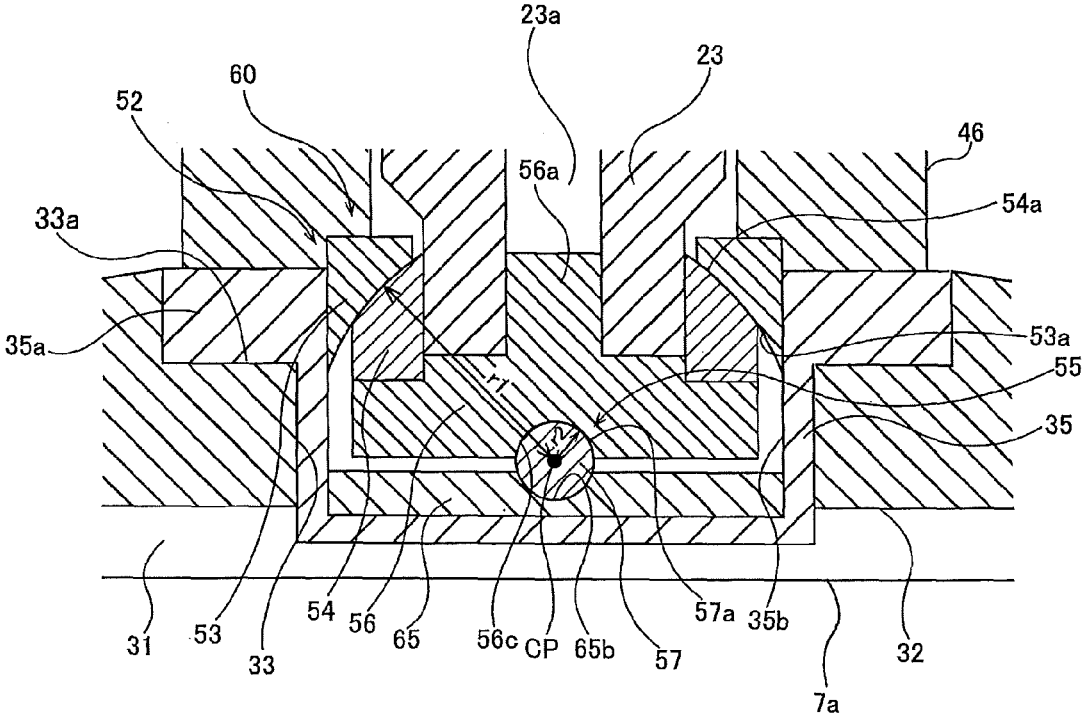
FIG. 7 is an enlarged view of the coupling mechanism shown in FIG. 6.

FIG. 7 is an enlarged view of the coupling mechanism 60 shown in FIG. 6. As shown in FIG. 7, a lower spherical bearing 55 of the coupling mechanism 60 has a fourth sliding-contact member 57 which is composed of a ball. This fourth sliding-contact member 57 is disposed between the third sliding-contact member 56 and the sleeve 35. In this embodiment, approximately an upper half of a spherical surface of the ball-shaped fourth sliding-contact member 57 serves as the fourth convex contact surface 57*a* of the lower spherical bearing 55. The third sliding-contact member 56 has, at its lower end, a third concave contact surface 56*c* formed therein. The fourth convex contact surface 57*a* of the fourth sliding-contact member 57 and the third concave contact surface 56*c* of the third sliding-contact member 56 slidably engage with one another. A base 65 is fixed to a bottom surface of the insertion recess 35*b* of the sleeve 35. This base 65 has a concave contact surface 65*b*. A lower portion of the spherical surface of the ball-shaped fourth sliding-contact member 57 slidably engages with the concave contact surface 65*b*. This base 65 may be integral with the sleeve 35.

The upper spherical bearing 52 and the lower spherical bearing 55 of the coupling mechanism 60 shown in FIG. 7 have different radii of rotation, while having the same rotational center CP. More specifically, the first concave contact surface 53*a*, the second convex contact surface 54*a*, the third concave contact surface 56*c*, and the fourth convex contact surface 57*a* are concentric, and their centers of curvature coincide with the rotational center CP. This rotational center CP is located below the first concave contact surface 53*a*, the second convex contact surface 54*a*, the third concave contact surface 56*c*, and the fourth convex contact surface 57*a*. More specifically, the rotational center CP corresponds to a center of the fourth sliding-contact member 57, and is located near the bottom end surface (i.e., the dressing surface 7*a*) of the dresser 7. In the illustrated example, the rotational center CP is located at a position higher than the bottom end surface of the dresser 7 by 6 mm.

The first concave contact surface 53*a* and the second convex contact surface 54*a* of the upper spherical bearing 52 is located above the third concave contact surface 56*c* and the fourth convex contact surface 57*a* of the lower spherical bearing 55. The dresser 7 is tiltably coupled to the dresser shaft 23 through the two spherical bearings, i.e., the upper spherical bearing 52 and the lower spherical bearing 55. Since the upper spherical bearing 52 and the lower spherical bearing 55 have the same rotational center CP, the dresser 7 can flexibly tilt in accordance with the undulation of the polishing surface 10*a* of the rotating polishing pad 10.

The upper spherical bearing 52 and the lower spherical bearing 55 can receive a force in a radial direction which is applied to the dresser 7, while the spherical bearings 52, 55 can continuously receive a force in an axial direction (i.e., in a direction perpendicular to the radial direction) which may cause the dresser 7 to vibrate. Further, the upper spherical bearing 52 and the lower spherical bearing 55 can exert a sliding force against a moment which is generated around the rotating center CP due to a frictional force generated between the dresser 7 and the polishing pad 10, while receiving the radial force and the axial force. As a result, the upper spherical bearing 52 and the lower spherical bearing 55 can prevent the flutter and the vibration of the dresser 7. In this embodiment, the moment due to the frictional force generated between the dresser 7 and the polishing pad 10 is hardly generated, because the rotational center CP is located near the bottom end surface of the dresser 7. As a result, the flutter or vibration of the dresser 7 can be prevented more effectively. Further, when the dresser 7 is elevated, the dresser 7 is supported by the upper spherical bearing 52. As a result, a dressing load on the polishing surface 10*a* can be finely controlled in a load range which is smaller than the gravity of dresser 7. Therefore, a fine dressing control can be performed. The structures of the O-ring 41, the O-ring 47, the first cylindrical cover 42, and the second cylindrical cover 48 shown in FIG. 5 may be applied to the embodiment shown in FIG. 6.

One of the first sliding-contact member 53 and the second sliding-contact member 54 shown in FIG. 2, FIG. 5, and FIG. 6 may preferably have a Young's modulus which is equal to or lower than a Young's modulus of the other, or may preferably have a damping coefficient which is higher than a damping coefficient of the other. In the coupling mechanisms shown in FIG. 2, FIG. 5, and FIG. 6, the second sliding-contact member 54 has a Young's modulus which is equal to or lower than a Young's modulus of the first sliding-contact member 53, or has a damping coefficient which is higher than a damping coefficient of the first sliding-contact member 53. With this structure, a vibration resistance of the dresser 7 can be improved. Specifically, the vibration of the dresser shaft 23, which is generated when receiving the frictional force generated between the dresser 7 and the polishing surface 10*a*, can be damped by one of the first sliding-contact member 53 and the second sliding-contact member 54. As a result, the flutter and the vibration of the dresser 7 can be prevented.

In this embodiment, the second sliding-contact member 54 has the Young's modulus which is equal to or lower than that of the first sliding-contact member 53, or has the damping coefficient which is higher than that of the first sliding-contact member 54. In a case where the first sliding-contact member 53 is made of a stainless steel, examples of a material constituting the second sliding-contact member 54 include resin, such as polyether ether ketone (PEEK), polyvinyl chloride (PVC), polytetrafluoroethylene (PTFE), and polypropylene (PP), and rubber, such as Viton (registered trademark). For example, the second sliding-contact member 54 shown in FIG. 2, FIG. 5, and FIG. 6 may be made of rubber.

The second sliding-contact member 54 preferably has the Young's modulus which is in a range of 0.1 GPa to 210 GPa, or the damping coefficient such that a damping ratio is in a range of 0.1 to 0.8. Where the damping ratio of the second sliding-contact member 54 is represented by $\zeta$, the damping coefficient of the second sliding-contact member 54 is represented by C, and a critical damping coefficient of the second sliding-contact member 54 is represented by Cc, the damping ratio $\zeta$ can be determined from an expression $\zeta = C/Cc$. Where a mass of the second sliding-contact member 54 is represented by m, and a spring constant of the second sliding-contact member 54 is represented by K, the critical damping coefficient Cc is expressed as $2\cdot(m\cdot K)^{1/2}$. Most preferably, the damping ratio of the second sliding-contact member 54 is 0.707. If the damping ratio is too large, the dresser 7 cannot flexibly follow the undulation of the polishing surface 10*a*.

Figure 8:
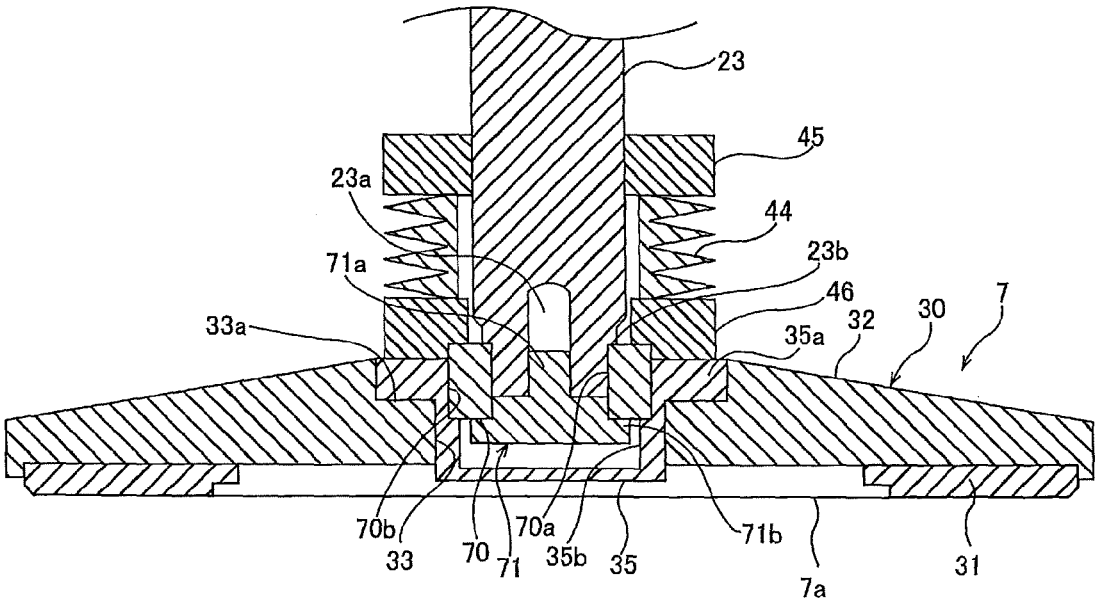
FIG. 8 is a schematic cross-sectional view showing still another embodiment of the coupling mechanism.

FIG. 8 is a schematic cross-sectional view showing still another embodiment of the coupling mechanism. The coupling mechanism of this embodiment is different from the above-described embodiments in that it does not have the upper spherical bearing and the lower spherical bearing. Other structures which will not be described particularly are identical to those of the above-described embodiments, and their repetitive explanations are omitted.

In the coupling mechanism shown in FIG. 8, a damping ring (or a damping member) 70 is secured to the lower end of the dresser shaft 23. In the illustrated embodiment, the damping ring 70 has an annular shape, and is fixed to the dresser shaft 23 by a fixing member 71. More specifically, a screw portion 71*a* of the fixing member 71 is screwed into the threaded hole 23*a* of the dresser shaft 23, so that the damping ring 70 is sandwiched between a shoulder portion 23*b* of the dresser shaft 23 and a flange portion 71*b* of the fixing member 71. The damping ring 70 is attached to the lower end of the dresser shaft 23 such that an inner circumferential surface 70*a* of the damping ring 70 is in contact with an outer circumferential surface of the lower end of the dresser shaft 23. Further, the damping ring 70 is attached to the sleeve 35 of the dresser 7 such that an outer circumferential surface 70*b* of the damping ring 70 is in contact with an inner circumferential surface of the insertion recess 35*b* of the sleeve 35. In this manner, the damping ring 70 is sandwiched between the lower end of the dresser shaft 23 and the sleeve 35 of the dresser 7, and the dresser 7 is coupled to the dresser shaft 23 through the damping ring 70. The torque of the dresser shaft 23 is transmitted to the dresser 7 through the damping ring 70 and the bellows 44. Further, the pressing force generated by the pneumatic cylinder 24 (see FIG. 1) is transmitted to the dresser 7 through the dresser shaft 23 and the damping ring 70.

The damping ring 70 has a Young's modulus which is equal to or lower than that of the dresser shaft 23, or has a damping coefficient which is higher than that of the dresser shaft 23. In a case where the dresser shaft 23 is made of a stainless steel, examples of a material which constitutes the damping ring 70 include resin, such as polyether ether ketone (PEEK), polyvinyl chloride (PVC), polytetrafluoroethylene (PTFE), and polypropylene (PP), and rubber, such as Viton (registered trademark). For example, the damping ring 70 shown in FIG. 8 may be made of rubber, and may be constructed as a rubber bush.

The damping ring 70 preferably has a Young's modulus which is in a range of 0.1 GPa to 210 GPa, or preferably has a damping coefficient such that a damping ratio is in a range of 0.1 to 0.8. Where the damping ratio of the damping ring 70 is represented by $\zeta$, the damping coefficient of the damping ring 70 is represented by C, and a critical damping coefficient of the damping ring 70 is represented by Cc, the damping ratio $\zeta$ can be determined from an expression $\zeta=C/Cc$. Where a mass of the damping ring 70 is represented by m, and a spring constant of the damping ring 70 is represented by K, the critical damping coefficient Cc is expressed as $2\cdot(m\cdot K)^{1/2}$. Most preferably, the damping ratio of the damping ring 70 is 0.707. If the damping ratio is too large, the dresser 7 cannot flexibly follow the undulation of the polishing surface 10*a*.

The damping ring 70, to which the dresser 7 is secured, has a Young's modulus which is equal to or lower than that of the dresser shaft (drive shaft) 23, or has a damping coefficient which is higher than that of the dresser shaft 23. When the polishing surface 10*a* of the rotating polishing pad 10 undulates, the damping ring 70 appropriately deforms, whereby the dresser 7 can appropriately follow the undulation of the polishing surface 10*a*. Further, a vibration resistance of the dresser 7 can be improved because the dresser 7 is secured to the dresser shaft 23 through the damping ring 70. More specifically, the vibration of the dresser 7 due to the frictional force, which is generated when the dresser 7 is in sliding contact with the polishing surface 10*a*, can be damped by the damping ring 70. As a result, the flutter and the vibration of the dresser 7 can be prevented. Further, the dressing load on the polishing surface 10*a* can be finely controlled in a load range which is smaller than the gravity of dresser 7, because the dresser 7 is coupled to the dresser shaft 23 through the damping ring 70. Therefore, a fine dressing control can be performed.

In a conventional dressing apparatus, when a dressing load for pressing a dresser against a polishing pad becomes larger, a stick-slip may occur between the dresser and the polishing pad. Conventionally, as a countermeasure for the stick-slip, a diameter of the dresser shaft has been increased so as to increase a stiffness of the dresser shaft. Further, in a case where a ball spline is used as a mechanism for rotating the dresser shaft, a pressure applied between a spline shaft and a spline nut has been increased. However, when the diameter of the dresser shaft is increased, or the pressure applied between the spline shaft and the spline nut is increased, a sliding resistance when the dresser shaft is vertically moved is increased. As a result, a fine control of the dressing load is inhibited.

According to the coupling mechanism of the embodiment shown in FIG. 8, the dresser 7 is secured to the damping ring 70 which is attached to the lower end of the dresser shaft 23. The vibration of the dresser 7 due to the frictional force generated when the dresser 7 is in sliding contact with the polishing surface 10*a* can be damped by the damping ring 70. As a result, the occurrence of the stick slip of the dresser 7 can be prevented. Therefore, the fine dressing control can be performed because it is not necessary to increase the diameter of the dresser shaft, or it is not necessary to increase the pressure applied between the spline shaft and the spline nut.

The above-described embodiments are directed to the coupling mechanism for coupling the dresser 7 to the dresser shaft 23. The coupling mechanism according to any one of the above-described embodiments may be used for coupling the polishing head 5 to the head shaft 14. The polishing head 5, supported by the coupling mechanism according to any one of the above-described embodiments, can follow the undulation of the polishing pad 10*a* of the rotating polishing pad 10 without generating flutter or vibration. Further, the above-described coupling mechanism can finely control a polishing load on the polishing surface 10*a* within a load range which is smaller than the gravity of polishing head 5. Therefore, a fine polishing control can be performed.

As described above, in the coupling mechanism 50 shown in FIG. 2 and FIG. 5, the distance h from the bottom end surface of the dresser 7 to the rotational center CP can be changed by appropriately selecting the radii of curvature of the first concave contact surface 53*a*, the second convex contact surface 54*a*, the third concave-contact surface 56*c*, and the fourth convex contact surface 57*a* that have the same rotational center CP. Specifically, a position of the rotational center CP of the coupling mechanism 50 can be changed. A method of determining a position of the rotational center CP of the coupling mechanism (i.e., the distance h from the bottom end surface of the dresser 7 to the rotational center CP) that does not cause the flutter or vibration of the rotating body will be described below.

Figure 9:
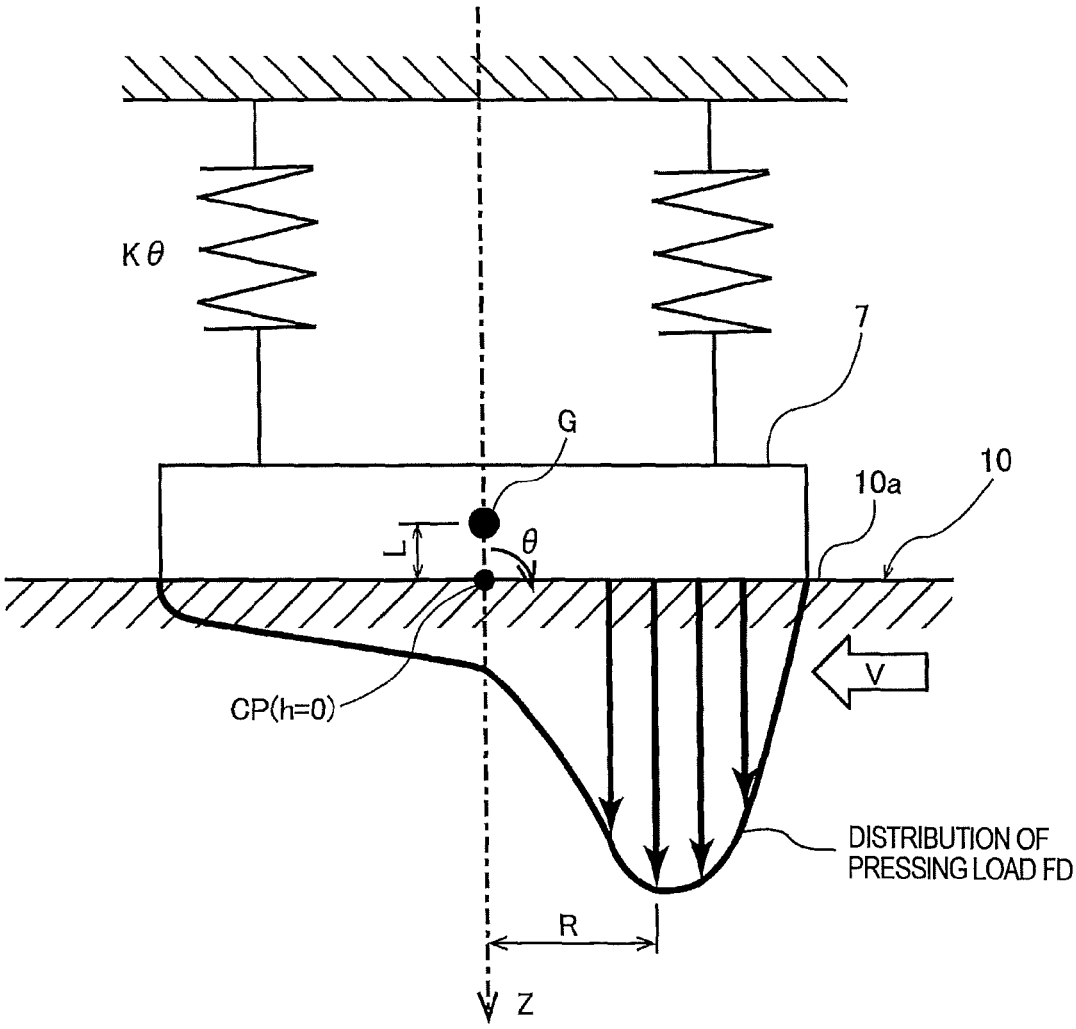
FIG. 9 is a model diagram showing a translational motion and a rotational motion in a case where a rotational center of the coupling mechanism shown in FIG. 2 is located on a bottom end surface of the dresser.
Figure 10:
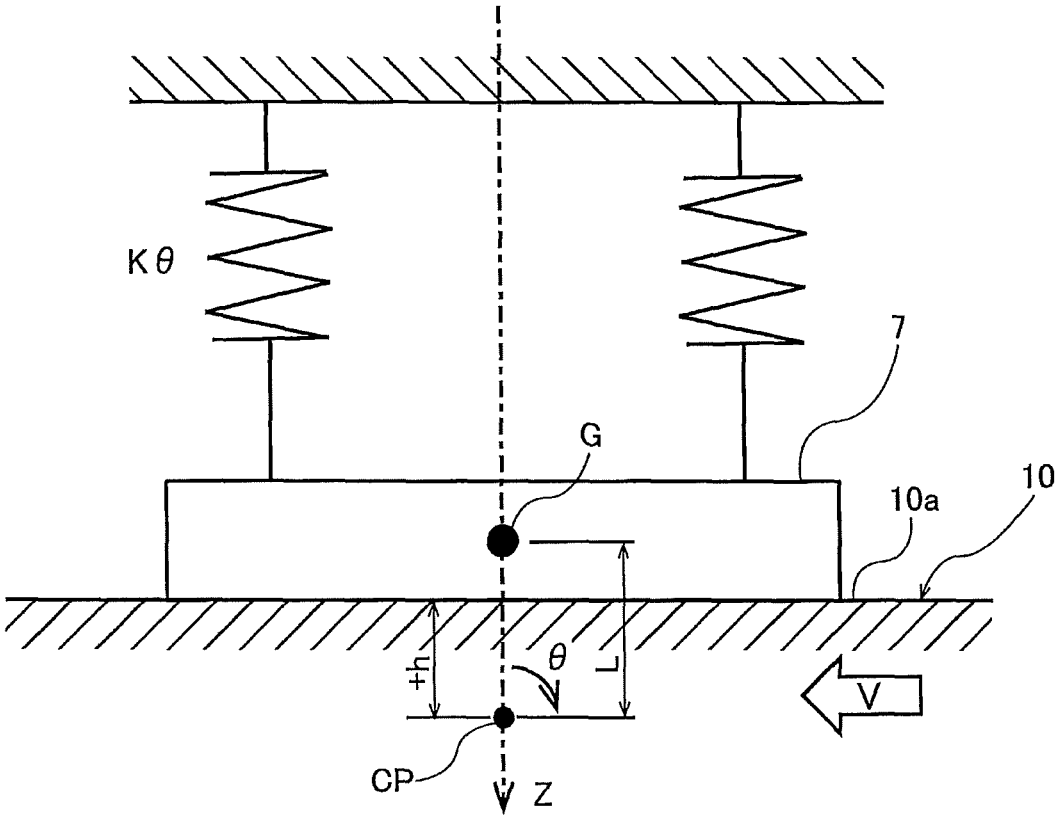
FIG. 10 is a model diagram showing a translational motion and a rotational motion in a case where a rotational center of the coupling mechanism shown in FIG. 2 is located below the bottom end surface of the dresser.
Figure 11:
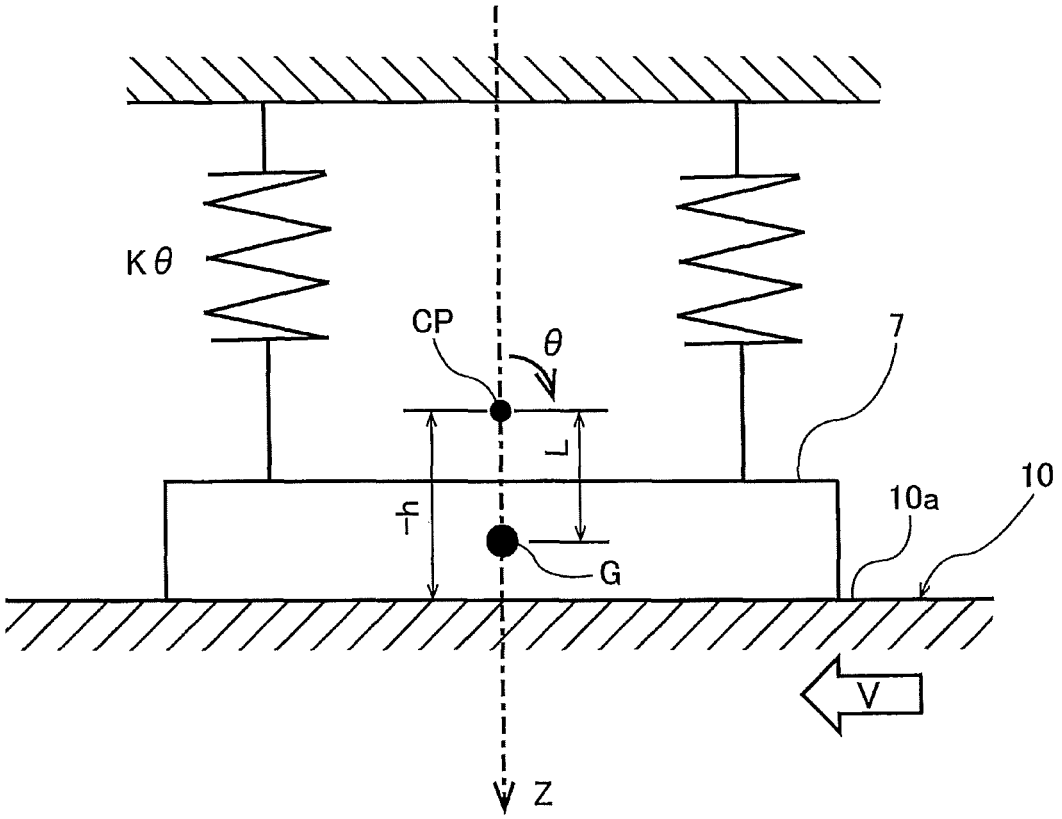
FIG. 11 is a model diagram showing a translational motion and a rotational motion in a case where a rotational center of the coupling mechanism shown in FIG. 2 is located above the bottom end surface of the dresser.

In the method of determining a position of the rotational center according to this embodiment, first, an equation of motion for a translational motion of the dresser (rotating body) 7 and an equation of motion for a tilting motion of the dresser 7 when the dresser 7 is in sliding contact with the rotating polishing pad 10 while rotating the dresser 7, are specified. FIG. 9 is model diagram showing a translational motion and a rotational motion in a case where the rotational center CP of the coupling mechanism 50 shown in FIG. 2 is located on the bottom end surface of the dresser 7. FIG. 10 is model diagram showing a translational motion and a rotational motion in a case where the rotational center CP of the coupling mechanism 50 shown in FIG. 2 is located below the bottom end surface of the dresser 7. FIG. 11 is model diagram showing a translational motion and a rotational motion in a case where the rotational center CP of the coupling mechanism 50 shown in FIG. 2 is located above the bottom end surface of the dresser 7.

As shown in FIGS. 9 through 11, in equations of motion which will be described later, the distance h from the bottom end surface of the dresser 7 to the rotational center CP is a numerical value on a coordinate axis Z which extends in a vertical direction with the origin located on the bottom end surface of the dresser (rotating body) 7. More specifically, the distance h is 0 when the rotational center CP is located on the bottom end surface of the dresser 7 (see FIG. 9), the distance h is a positive number when the rotational center CP is located below the bottom end surface of the dresser 7 (see FIG. 10), and the distance h is a negative number when the rotational center CP is located above the bottom end surface of the dresser 7 (see FIG. 11).

A sliding velocity of the dresser 7 is represented by s, a relative velocity of the dresser 7 with respect to the polishing pad 10 is represented by V, and a velocity of the dresser 7 when the dresser 7 is slightly displaced with respect to the polishing pad 10 by x in the horizontal direction due to the friction between the dresser 7 and the polishing pad 10 is represented by x'. In this case, the sliding velocity s, the relative velocity V, and the displacement velocity x' satisfy the following expression (1).

$$s=V-x' \tag{1}$$

Further, if a coefficient of friction between the dresser 7 and the polishing pad 10 is represented by μ, a symbol μ' is defined by the following expression (2).

$$\mu'=(d\mu/ds) \tag{2}$$

The symbol μ' can be obtained also from a Stribeck curve, for example. The symbol μ' corresponds to a slope of a tangential line on the Stribeck curve.

A force F0 applied to the dresser 7 in the horizontal direction is represented by the following expression (3).

$$\begin{aligned} F0 &= (\mu 0+\mu'\cdot s)\cdot FD \\ &= (\mu 0+\mu'\cdot V)\cdot FD-\mu'\cdot FD\cdot x' \end{aligned} \tag{3}$$

where μ0 is a coefficient of static friction between the dresser 7 and the polishing pad 10, and FD is a pressing load applied to the dresser 7 when the dresser 7 is pressed against the polishing pad 10.

Due to the sliding velocity s(=V−x'), a center of a distribution of the pressing force FD, which is applied to the polishing pad 10 from the dresser 7, shifts from the center of the dresser 7 (see FIG. 9). When a shifting amount of the center of the distribution of the pressing load FD from the center of the dresser 7 is represented by a load radius R, the following expression (4) is defined.

$$R=f(V-x') \tag{4}$$

The expression (4) indicates that the load radius R is determined by the function f which uses the sliding velocity s (=V−x') as a variable. The function f is such that the load radius R is 0 when the relative velocity V is 0, and that the load radius R reaches a radius Rd of the dresser 7 when the relative velocity V is infinity.

When the pressing load of the dresser 7 at a radial position R(i) of the dresser 7 is represented by FD(i), a sum M of moments produced by the pressing loads FD(i) is expressed by the following expression (5).

$$M=\Sigma(R(i)\cdot FD(i)) \tag{5}$$

Further, the load radius R is defined by the following expression (6).

$$R=M/FD=\mathrm{Rd}\cdot(V-x')\cdot\eta \tag{6}$$

where η is a ratio of the load radius R to the radius Rd of the dresser 7. For example, when the center of the distribution of the pressing load FD is located at a middle point between the center and a periphery of the dresser 7, a value of η is 0.5.

A moment M0 around the rotational center CP, which is applied to the dresser 7 when the dresser 7 follows the undulation of the polishing surface 10*a* of the polishing pad 10 to tilt by an angle of rotation θ about the rotational center CP, is represented by the following expression (7).

$$\begin{aligned} M0 &= (\mu 0+\mu'\cdot s)\cdot FD\cdot h+\eta\cdot FD\cdot Rd\cdot(V-x') \\ &= (\mu 0+\mu'\cdot V)\cdot FD\cdot h-\mu'\cdot FD\cdot h^2\cdot\theta'+ \\ &\quad \eta\cdot FD\cdot Rd\cdot V-\eta\cdot FD\cdot Rd\cdot h\cdot\theta') \end{aligned} \tag{7}$$

where θ' is an angular velocity when the dresser 7 tilts about the rotational center CP by the angle of rotation θ.

From the above-described expressions (1) through (7), the equation of motion for the translational motion of the dresser (rotating body) 7 and the equation of motion for the tilting motion of the dresser 7 can be specified. The equation of motion for the translational motion of the dresser 7 is represented by the following expression (8).

$$m\cdot x''+(Cx+\mu'\cdot FD)\cdot x'+Kx+x=(\mu 0+\mu'\cdot V)\cdot FD \tag{8}$$

where m is mass of a displacement portion which tilts about the rotational center CP due to the undulation of the polishing pad 10. In the embodiment shown in FIG. 2, the displacement portion includes not only the dresser 7 but also the lower cylindrical portion 46 (see FIG. 2) connected to the lower portion of the bellows 44. Therefore, the mass m of the displacement portion is a sum of a mass of the dresser 7 and a mass of the lower cylindrical portion 46. The symbol x" is an acceleration of the dresser 7 when the dresser 7 is displaced by x in the horizontal direction relative to the polishing pad 10 due to the friction between the dresser 7 and the polishing pad 10. The symbol Cx is a damping coefficient in the translational motion, and Kx is a stiffness of the translational motion.

In a left side of the expression (8), a term (Cx+μ'FD)·x' is a velocity term in the equation of motion for the translational motion. When this velocity term has a negative number, the translational motion of the dresser 7 becomes unstable (i.e., diverges). More specifically, when this velocity term has a negative number, the flutter or vibration of the dresser 7 occurs. Therefore, the following expression (9) serves as a stability condition expression for the translational motion for preventing the occurrence of the flutter or vibration of the dresser 7.

$$(Cx+\mu'\cdot FD)>0 \tag{9}$$

As can be seen from the stability condition expression for the translational motion, when the value of μ' is negative, the velocity term in the equation of motion for the translational motion is likely to have a negative number. Specifically, when the value of μ' is negative, the flutter or vibration of the dresser 7 is likely to occur. The value of μ' is typically negative when the relative velocity V of the dresser 7 with respect to the polishing pad 10 is low and the pressing load FD of the dresser 7 is large.

The equation of motion for the tilting motion of the dresser 7 is represented by the following expression (10).

$$(Ip+m\cdot L^2)\cdot\theta''+(C+\mu'\cdot FD\cdot h^2+\eta\cdot FD\cdot \mathrm{Rd}\cdot h)\cdot\theta'+(K\theta+K\mathrm{pad})\cdot\theta=(\mu 0+\mu'\cdot V)\cdot FD\cdot h+\eta\cdot FD\cdot \mathrm{Rd}\cdot V \quad (10)$$

where $(Ip+m\cdot L^2)$ represents a moment of inertia of the displacement portion that tilts about the rotational center CP due to the undulation of the polishing pad 10, and L represents a distance from a center of inertia (a center of inertial mass) G of the displacement portion to the rotational center CP. The symbol Ip represents a moment of inertia of the center of inertial mass. The symbol θ" represents an angular acceleration when the dresser 7 is rotated about the rotational center CP by the angle of rotation θ. Further, C represents a damping coefficient around the rotational center CP, Kθ represents a tilt stiffness around the rotational center CP, and Kpad represents a tilt stiffness around the rotational center CP produced by an elastic property of the polishing pad.

In a left side of the expression (10), a term $(C+\mu'\cdot FD\cdot h^2+\eta\cdot FD\cdot Rd\cdot h)\cdot\theta'$ is a velocity term in the equation of motion for the tilting motion. When this velocity term has a negative number, the tilting motion of the dresser 7 becomes unstable (i.e., diverges). More specifically, when this velocity term has a negative number, the flutter or vibration of the dresser 7 is likely to occur. Therefore, the following expression (11) serves as a stability condition expression for the tilting motion for preventing the occurrence of the flutter or vibration of the dresser 7.

$$(C+\mu'\cdot FD\cdot h^2+\eta\cdot FD\cdot \mathrm{Rd}\cdot h)>0 \quad (11)$$

As can be seen from the stability condition expression for the tilting motion, when the value of μ' is negative, the velocity term in the equation of motion for the tilting motion is likely to have a negative number. Specifically, when the value of μ' is negative, the flutter or vibration of the dresser 7 is likely to occur. Further, when the distance h is negative, the velocity term is likely to have a negative number. More specifically, when the rotational center CP is located above the bottom end surface of the dresser 7, the flutter or vibration of the dresser 7 is likely to occur. In contrast, when the distance h is positive, the velocity term in the equation of motion for the tilting motion is likely to have a positive number. More specifically, when the rotational center CP is located below the bottom end surface of the dresser 7, the flutter or vibration of the dresser 7 is less likely to occur. Further, when the distance h is positive, the stability condition expression for the tilting motion may be satisfied even when μ' is a negative number. More specifically, when the rotational center CP is located below the bottom end surface of the dresser 7, the occurrence of the flutter or vibration of the dresser 7 can be effectively prevented.

Further, when the distance h is 0 (i.e., the rotational center CP is located on the bottom end surface of the dresser 7), the stability condition expression for the tilting motion can be satisfied regardless of the pressing load FD of the dresser 7, the radius Rd of the dresser 7, and the values of μ'.

In this manner, in the method of determining a position of the rotational center according to this embodiment, the expression (11) that is the stability condition expression for the tilting motion is specified based on the expression (10) that is the equation of motion for the tilting motion. Further, in the method of determining a position of the rotational center according to this embodiment, the expression (11) is solved for the distance h to thereby calculate a range of the distance h which is represented by the following expression (12).

$$(-b-(b^2-4\cdot a\cdot c)^{1/2})/(2\cdot a)<h<(-b+(b^2-4\cdot a\cdot c)^{1/2})/(2\cdot a) \quad (12)$$

From the expression (12), a lower limit hmin and an upper limit hmax of the distance h, which can prevent the flutter or vibration of the dresser 7, can be expressed by the following expressions (13) and (14), respectively.

$$h\mathrm{min}=(-b-(b^2-4\cdot a\cdot c)^{1/2})/(2\cdot a) \quad (13)$$

$$h\mathrm{max}=(-b+(b^2-4\cdot a\cdot c)^{1/2})/(2\cdot a) \quad (14)$$

In the expressions (12) through (14), a represents μ'·FD, b represents η·FD·Rd, and c represents the damping coefficient C around the rotational center CP.

The expression (12) indicates the range of the distance h (i.e., the position of the rotational center CP) that can prevent the occurrence of the flutter or vibration of the dresser 7. Therefore, in the method of determining a position of the rational center according to this embodiment, the position of the rotational center CP is determined so as to satisfy the expression (12). More specifically, the radii of curvature of the first concave contact surface 53*a*, the second convex contact surface 54*a*, the third concave-contact surface 56*c*, and the fourth convex contact surface 57*a* are selected so as to determine the position of the rotational center CP. The range of the distance h that can prevent the flutter or vibration of the dresser 7 may be calculated with use of a value of μ' which is expected from a property of the polishing pad 10, or with use of a value of μ' which is obtained from the Stribeck curve. In either case, the largest negative number, which has been expected or obtained, is preferably used as the value of μ'. The pressing load FD may preferably be a maximum pressing load used in a dressing process. Further, the ratio η of the load radius R to the radius Rd of the dresser 7 may be determined from an expected maximum relative velocity V, or may be a predetermined value which has been obtained from experiments or the like (for example, η is assumed to be 0.8). The damping coefficient C around the rotational center CP is set to a predetermined value which has been obtained from experiments or the like (for example, C is assumed to be 0.05).

The dresser 7 is preferably configured to tilt quickly in response to the undulation of the polishing surface 10*a* of the polishing pad 10. A responsiveness of the tilting motion of the dresser 7 for the undulation of the polishing pad 10*a* is proportional to a natural frequency ωθ of the displacement portion, and the highest responsiveness is achieved when this natural frequency ωθ is maximum. The natural frequency ωθ is represented by the following expression (15).

$$\omega\theta=((K\theta+K\mathrm{pad})/(Ip+m\cdot L^2))^{1/2} \quad (15)$$

As can be seen from the expression (15), the natural frequency ωθ is proportional to the tilt stiffness Kθ around the rotational center CP, and is inversely proportional to the moment of inertia Ip of the center of inertial mass and a distance L from the center of inertia G of the displacement portion to the rotational center CP. When the distance L is 0, the natural frequency ωθ becomes maximum. More specifically, when the rotational center CP coincides with the center of inertia G of the displacement portion, the highest responsiveness of the dresser 7 for the undulation of the polishing pad 10 is achieved. Therefore, if the distance from the bottom end surface of the dresser 7 to the center of inertia G falls within the range of the distance h that has been specified by the expression (12), it is preferred to determine the rotational center CP which coincides with the center of inertia G.

Figure 12:
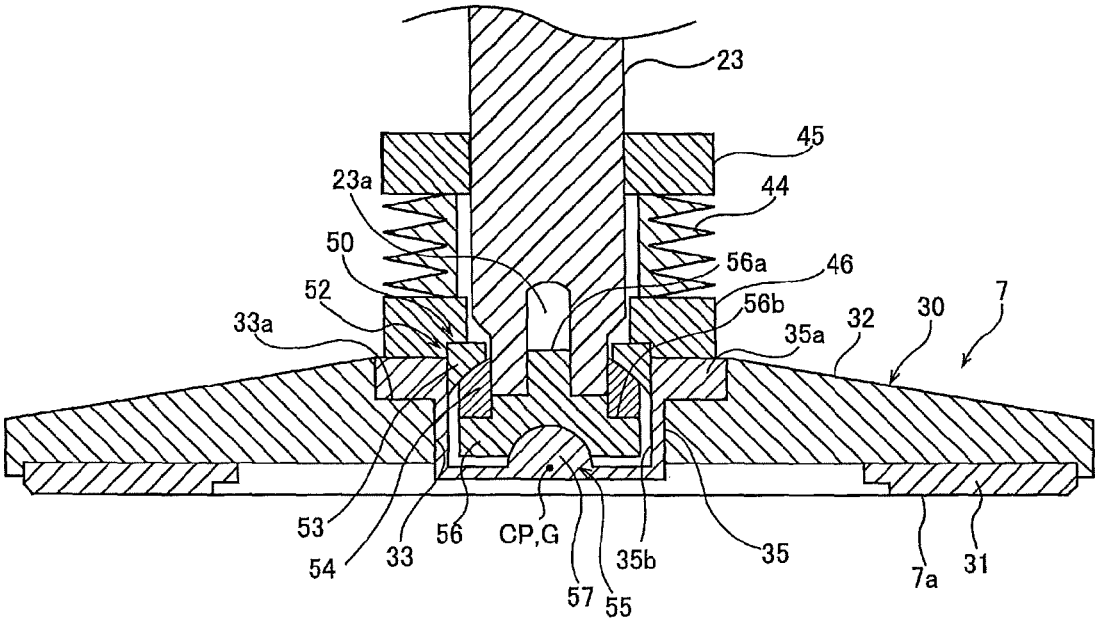
FIG. 12 is a schematic cross-sectional view showing a dresser supported by a coupling mechanism in which the rotational center coincides with a center of inertia of a displacement portion.

FIG. 12 is a schematic cross-sectional view showing the dresser 7 supported by the coupling mechanism 50 in which the rotational center CP coincides with the center of inertia G of the displacement portion. Structures of the coupling mechanism 50 according to the embodiment shown in FIG. 12, except that the rotational center CP coincides with the center of inertia G, are identical to those of the coupling mechanism 50 according to the embodiment shown in FIG. 2, and repetitive descriptions thereof are omitted.

In the embodiment shown in FIG. 12, the distance h from the bottom end surface of the dresser 7 to the rotational center CP is −7 mm, and this rotational center CP coincides with the center of inertia G of the displacement portion. In the case where the rotational center CP coincides with the center of inertia G as shown in FIG. 12, the dresser 7 can optimally follow the undulation of the polishing surface 10*a* of the polishing pad 10. Although not shown in the drawings, in order to improve the responsiveness of the tilting motion of the dresser 7 for the undulation of the polishing pad 10*a* of the polishing pad 10 while preventing the flutter or vibration of the dresser 7, the rotational center CP may be selected within the range from the bottom end surface of the dresser 7 to the center of inertia G of the displacement portion.

Next, a relationship between the damping ratio ζ of the tilting motion of the displacement portion that tilts about the rotational center CP, and the distance h from the bottom end surface of the dresser (rotating body) 7 to the rotational center CP will be described. The critical damping coefficient Cc of the displacement portion is expressed by the following expression (16).

$$Cc=2\cdot((Ip+m\cdot L^2)\cdot(K\theta+Kpad))^{1/2} \tag{16}$$

Further, the damping ratio is expressed by the following expression (17).

$$\zeta=\sum C/Cc=(C+\mu'\cdot FD\cdot h^2+\eta\cdot FD\cdot Rd\cdot h)/2\cdot((Ip+m\cdot L^2)\cdot(K\theta+Kpad))^{1/2} \tag{17}$$

When the damping ratio ζ expressed by the expression (17) is a negative number, the tilting motion of the dresser 7 becomes unstable (i.e., diverges). More specifically, when the damping ratio ζ is a negative number, the flutter or vibration of the dresser 7 occurs.

Figure 13:
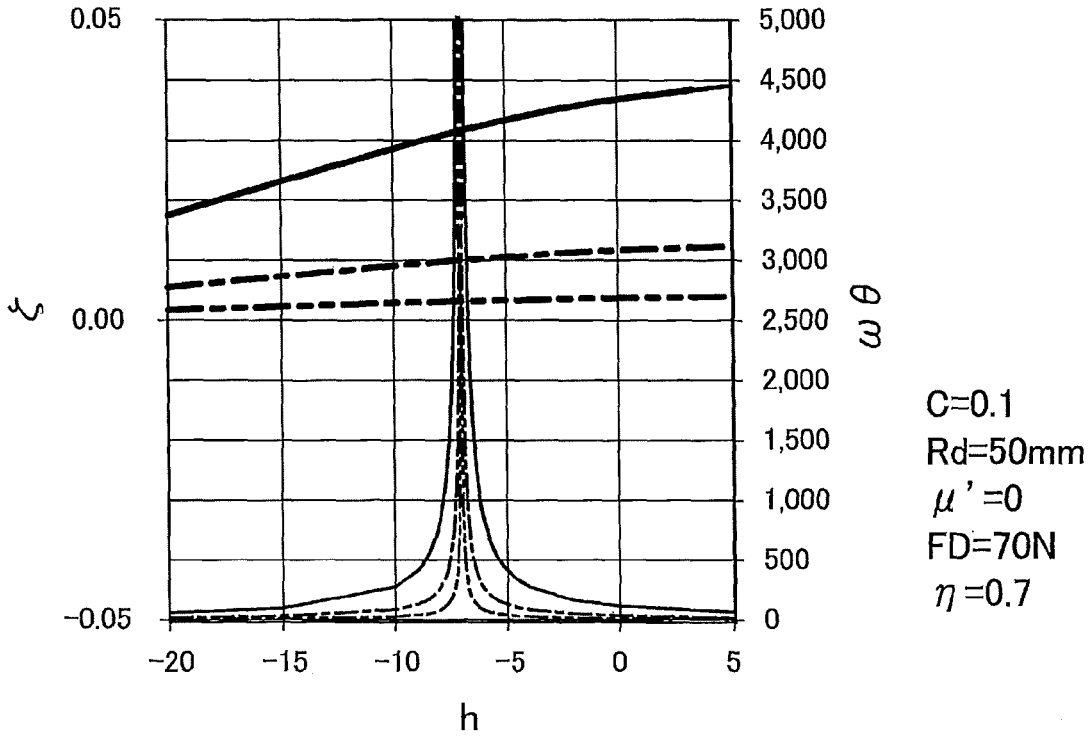
FIG. 13 is a graph showing an example of simulation results of a relationship between a damping ratio $\zeta$ of a tilting motion of the displacement portion which tilts about the rotational center and a distance h from the bottom end surface of the dresser to the rotational center.
Figure 14:
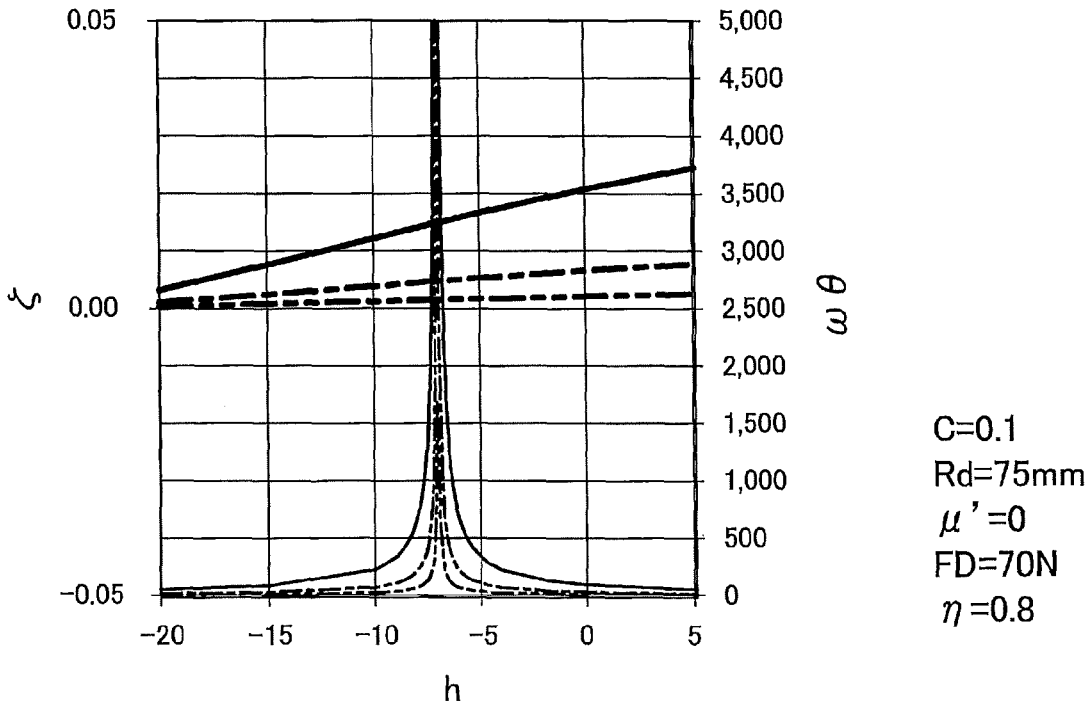
FIG. 14 is a graph showing another example of simulation results of the relationship between the damping ratio $\zeta$ of the tilting motion of the displacement portion which tilts about the rotational center and the distance h from the bottom end surface of the dresser to the rotational center.

Based on the expression (17), a relationship between the damping ratio ζ of tilting motion of the displacement portion and the distance h from the bottom end surface of the dresser (rotating body) 7 to the rotational center CP was simulated. FIG. 13 is a graph showing an example of simulation results of the relationship between the damping ratio ζ of the tilting motion of the displacement portion which tilts about the rotational center CP, and the distance h from the bottom end surface of the dresser 7 to the rotational center CP. FIG. 14 is a graph showing another example of simulation results of the relationship between the damping ratio ζ of the tilting motion of the displacement portion which tilts about the rotational center CP, and the distance h from the bottom end surface of the dresser 7 to the rotational center CP. FIG. 13 illustrates the simulation results of the dresser 7 (whose diameter is 100 mm) used for the polishing pad 10 for polishing a wafer with a diameter of 300 mm. FIG. 14 illustrates the simulation results of the dresser 7 (whose diameter is 150 mm) used for the polishing pad 10 for polishing a wafer with a diameter of 450 mm.

A left vertical axis in the graph shown in FIG. 13 represents the damping ratio ζ, and a horizontal axis in the graph shown in FIG. 13 represents the distance h from the bottom end surface of the dresser 7 to the rotational center CP. Further, a right vertical axis in the graph shown in FIG. 13 represents the natural frequency ωθ. In FIGS. 14 through 20, which will be described later, a left vertical axis represents the damping ratio ζ, a horizontal axis represents the distance h from the bottom end surface of the dresser 7 to the rotational center CP, and a right vertical axis represents the natural frequency ωθ, as well.

The simulations, results of which are shown in FIG. 13, were performed based on the expression (17) under the following simulation conditions.

The damping coefficient C around the rotational center CP=0.1

μ'=0

The pressing load FD of the dresser 7=70 [N]

η=0.7

The radius Rd of the dresser 7=50 [mm]

The moment of inertia Ip of the center of inertial mass=0.00043 [kg·m$^2$]

The mass m of the displacement portion=0.584 [kg]

The distance L between the center of inertia G of the displacement portion and the rotational center CP=9+h [mm]

In FIG. 13, a thick solid line represents a simulation result of the damping ratio ζ in a case where ΣK(=Kθ+Kpad) that is the sum of Kθ and Kpad is 4000, a thick chain line represents a simulation result of the damping ratio ζ in a case where ΣK is 40000, and a two-dot chain line represents a simulation result of the damping ratio ζ in a case where ΣK is 400000. Further, in FIG. 13, a thin solid line represents a simulation result of the natural frequency ωθ in the case where ΣK is 4000, a thin chain line represents a simulation result of the natural frequency ωθ in the case where ΣK is 40000, and a thin two-dot chain line represents a simulation result of the natural frequency ωθ in the case where ΣK is 400000. In FIGS. 14 through 20, which will be described later, a thick solid line represents a simulation result of the damping ratio ζ in a case where ΣK(=Kθ+Kpad) that is the sum of Kθ and Kpad is 4000, a thick chain line represents a simulation result of the damping ratio ζ in a case where ΣK is 40000, and a thick two-dot chain line represents a simulation result of the damping ratio ζ in a case where ΣK is 400000, as well. Further, in FIGS. 14 through 20, a thin solid line represents a simulation result of the natural frequency ωθ in the case where ΣK is 4000, a thin chain line represents a simulation result of the natural frequency ωθ in the case where ΣK is 40000, and a thin two-dot chain line represents a simulation result of the natural frequency ωθ in the case where ΣK is 400000.

The simulations, the results of which are shown in FIG. 14, were performed based on the expression (17) under the following simulation conditions.

The damping coefficient C around the rotational center CP=0.1

μ'=0

The pressing load FD of the dresser 7=70 [N]

η=0.8

The radius Rd of the dresser 7=75 [mm]

The moment of inertia Ip of the center of inertial mass=0.0014 [kg·m$^2$]

The mass m of the displacement portion=0.886 [kg]

The distance L between the center of inertia G of the displacement portion and the rotational center CP=7+h [mm]

In the simulations whose results are shown in FIG. 13 and FIG. 14, respectively, the value of μ' was set to 0. As shown in FIG. 13, in the case where the radius Rd of the dresser 7 is 50 mm, the damping ratio ζ is a positive number even when the value of ΣK is 400000. As a result, the flutter or vibration of the dresser 7 does not occur. In contrast, as shown in FIG. 14, in the case where the radius Rd of the dresser 7 is 75 mm, the damping ratio ζ is almost 0 when the value of ΣK is 400000 and the distance h is −18 mm. Therefore, when the distance h is smaller than −18 mm (i.e., when the rotational center CP is located at a position higher than the bottom end surface of the dresser 7 by 18 mm or more), the flutter or vibration of the dresser 7 occurs. Further, it can be seen from the comparison between FIG. 13 and FIG. 14 that, as the radius Rd of the dresser 7 increases, the flutter or vibration of the dresser 7 is likely to occur. Further, as shown in FIGS. 13 and 14, as the value of ΣK increases, the damping ratio ζ decreases, and as a result, the flutter or vibration of the dresser 7 is likely to occur.

Figure 15:
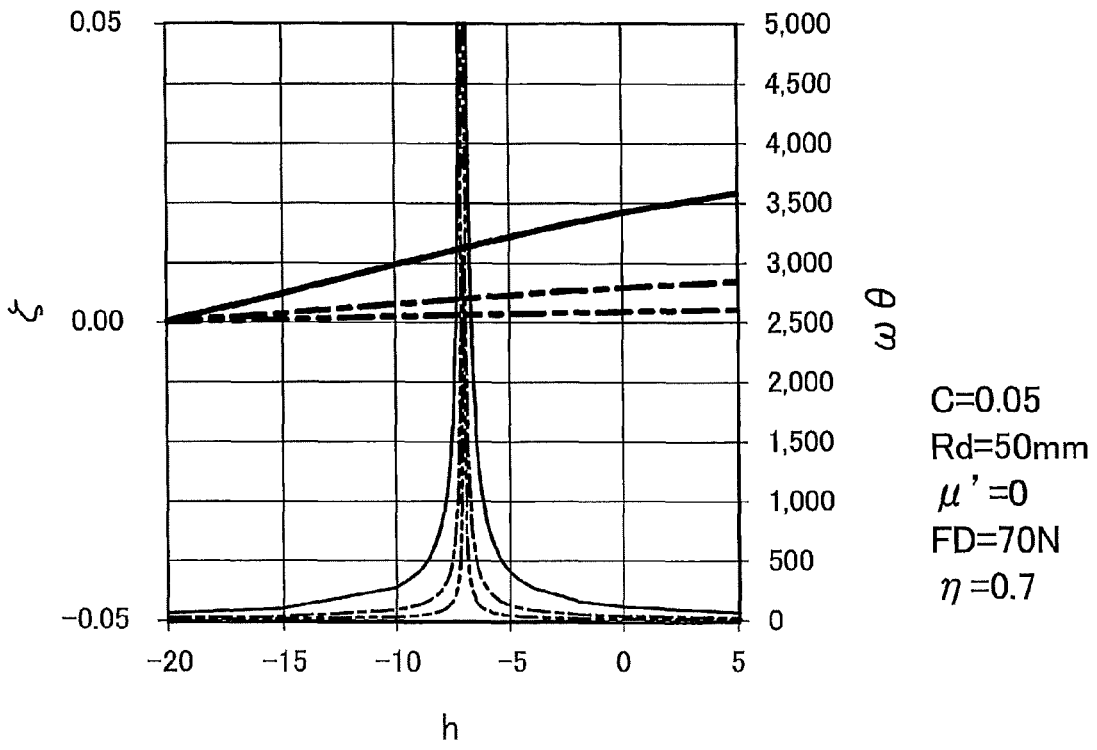
FIG. 15 is a graph showing still another example of simulation results of the relationship between the damping ratio $\zeta$ of the tilting motion of the displacement portion which tilts about the rotational center and the distance h from the bottom end surface of the dresser to the rotational center.

FIG. 15 is a graph showing still another example of simulation results of the relationship between the damping ratio ζ of the tilting motion of the displacement portion which tilts about the rotational center CP, and the distance h from the bottom end surface of the dresser 7 to the rotational center CP. In the simulations whose results are shown in FIG. 15, the damping coefficient C was set to 0.05. In the simulations whose results are shown in FIG. 15, simulation conditions, except for the damping coefficient C around the rotational center CP, were identical to those of the simulations whose results are shown in FIG. 13.

As shown in FIG. 15, when ΣK is 40000 and 400000 and when the distance h is −17 mm, the damping ratio ζ is almost 0. Therefore, when the distance h is smaller than −17 mm, the flutter or vibration is likely to occur. It can be seen from the comparison between FIG. 13 and FIG. 15 that, as the damping coefficient C around the rotational center CP decreases, the flutter or vibration of the dresser 7 is likely to occur.

Figure 16:
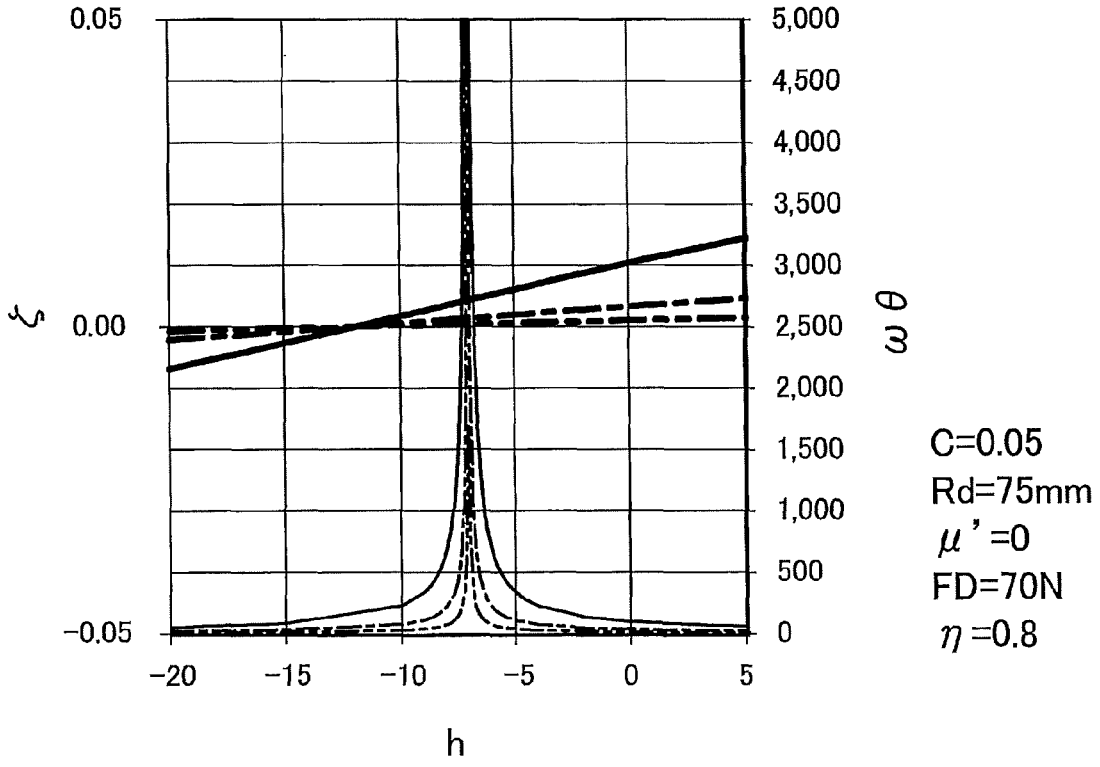
FIG. 16 is a graph showing still another example of simulation results of the relationship between the damping ratio $\zeta$ of the tilting motion of the displacement portion which tilts about the rotational center and the distance h from the bottom end surface of the dresser to the rotational center.

FIG. 16 is a graph showing still another example of simulation results of the relationship between the damping ratio ζ of the tilting motion of the displacement portion which tilts about the rotational center CP, and the distance h from the bottom end surface of the dresser 7 to the rotational center CP. In the simulations whose results are shown in FIG. 16, the damping coefficient C was set to 0.05. In the simulations whose results are shown in FIG. 16, simulation conditions, except for the damping coefficient C around the rotational center CP, were identical to those of the simulations whose results are shown in FIG. 14.

As shown in FIG. 16, when the distance h is smaller than −12 mm, the value of damping ratio ζ is a negative number regardless of the value of ΣK. Therefore, when the distance h is smaller than −12 mm, the flutter or vibration of the dresser 7 occurs. It can be seen from the comparison between FIG. 14 and FIG. 16 that, as the damping coefficient C around the rotational center CP decreases, the flutter or vibration of the dresser 7 is likely to occur.

Figure 17:
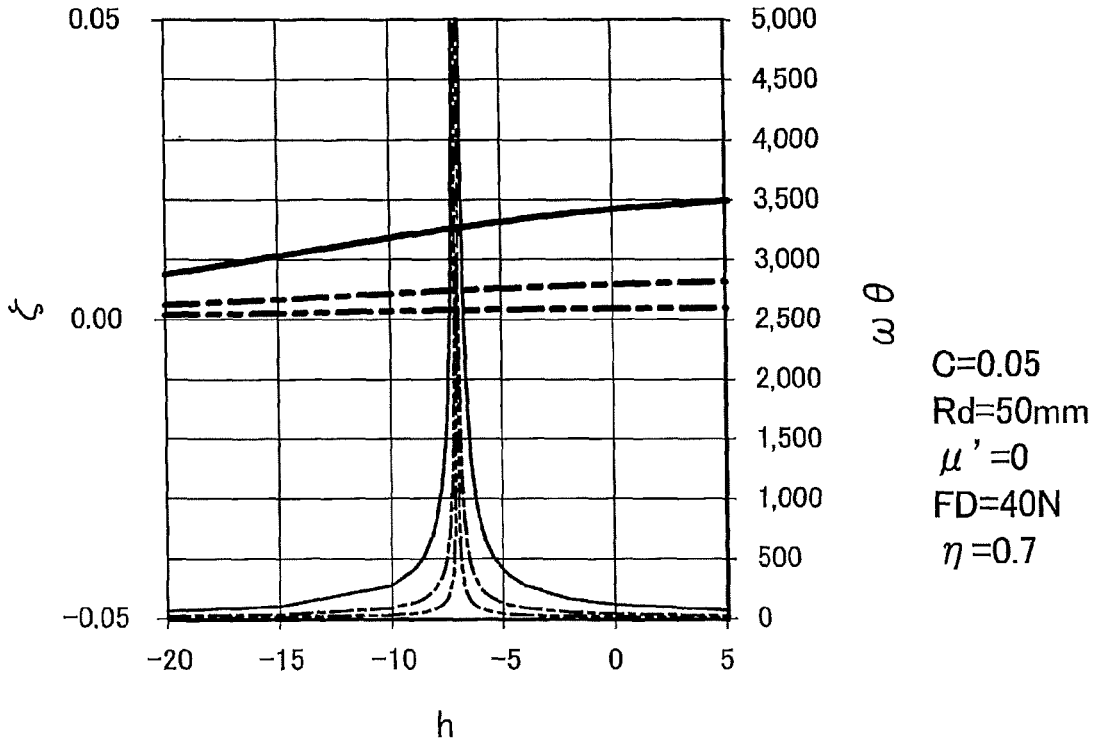
FIG. 17 is a graph showing still another example of simulation results of the relationship between the damping ratio $\zeta$ of the tilting motion of the displacement portion which tilts about the rotational center and the distance h from the bottom end surface of the dresser to the rotational center.

FIG. 17 is a graph showing still another example of simulation results of the relationship between the damping ratio ζ of the tilting motion of the displacement portion which tilts about the rotational center CP, and the distance h from the bottom end surface of the dresser 7 to the rotational center CP. In the simulation whose results are shown in FIG. 17, the pressing load FD of the dresser 7 was set to 40 N. In the simulations whose results are shown in FIG. 17, simulation conditions, except for the pressing load of the dresser 7, were identical to those of the simulations whose results are shown in FIG. 15.

Figure 18:
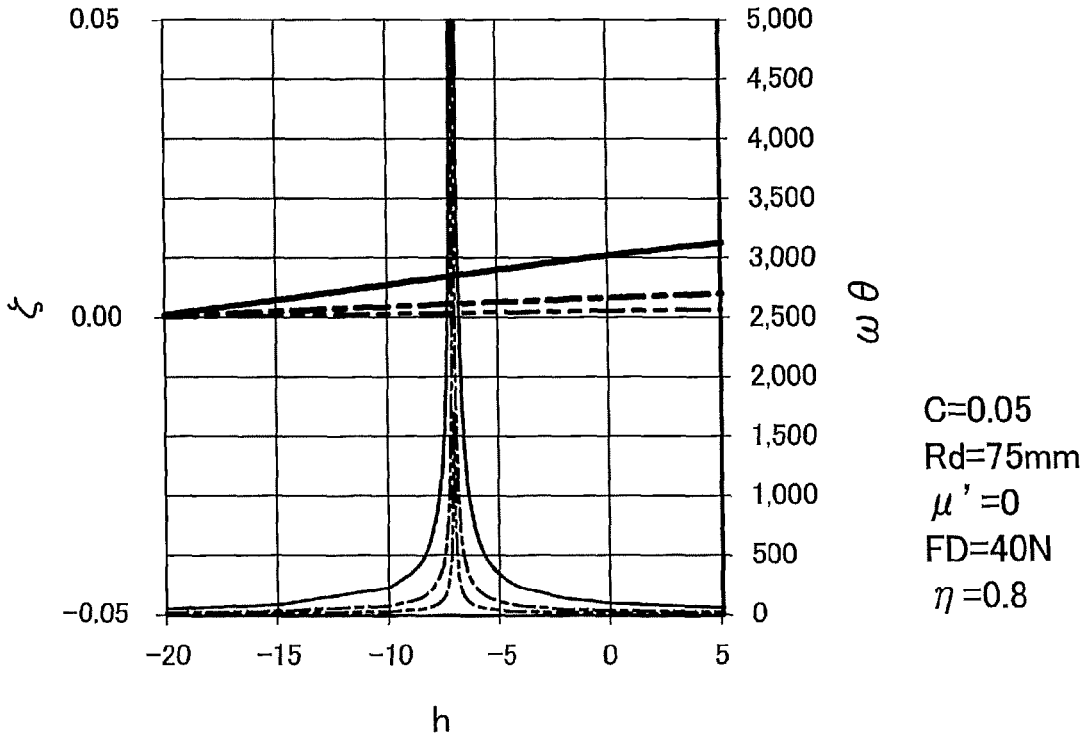
FIG. 18 is a graph showing still another example of simulation results of the relationship between the damping ratio $\zeta$ of the tilting motion of the displacement portion which tilts about the rotational center and the distance h from the bottom end surface of the dresser to the rotational center.

FIG. 18 is a graph showing still another example of simulation results of the relationship between the damping ratio ζ of the tilting motion of the displacement portion which tilts about the rotational center CP, and the distance h from the bottom end surface of the dresser 7 to the rotational center CP. In the simulations whose results are shown in FIG. 18, the pressing load FD of the dresser 7 was set to 40 N. In the simulations whose results are shown in FIG. 18, simulation conditions, except for the pressing load FD of the dresser 7, were identical to those of the simulations whose results are shown in FIG. 16.

It can be seen from a comparison between FIG. 15 and FIG. 17 and a comparison between FIG. 16 and FIG. 18 that, as the pressing load FD of the dresser 7 increases, the flutter or vibration is likely to occur.

Figure 19:
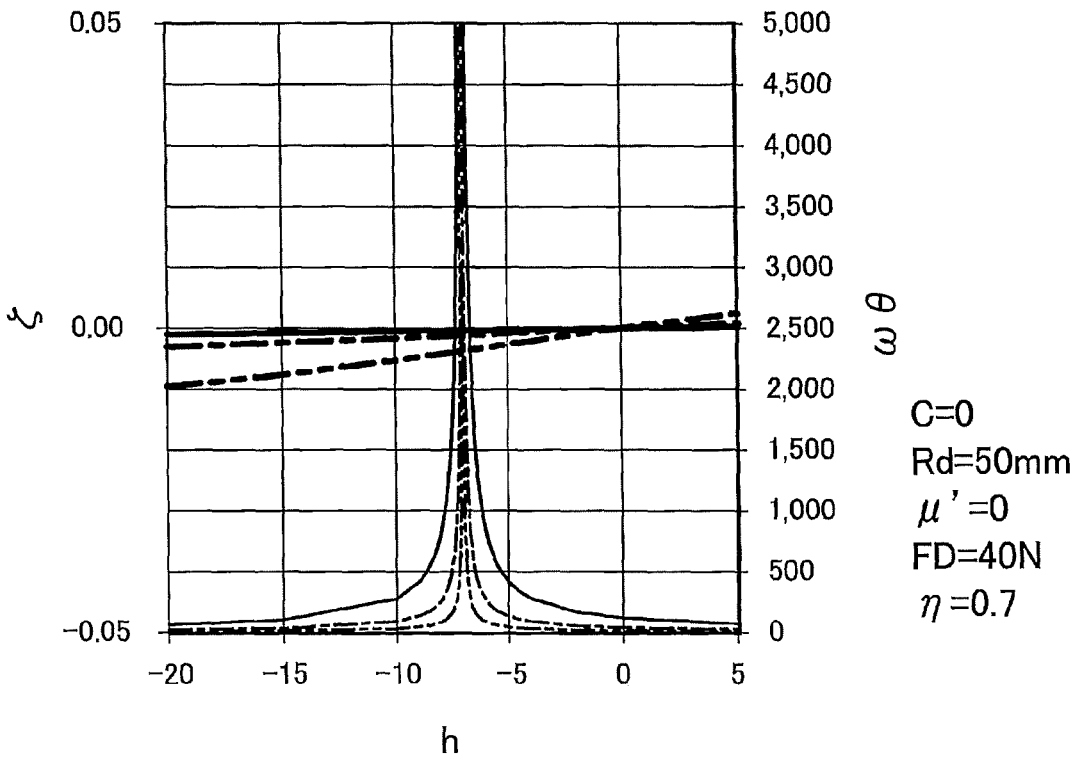
FIG. 19 is a graph showing still another example of simulation results of the relationship between the damping ratio $\zeta$ of the tilting motion of the displacement portion which tilts about the rotational center and the distance h from the bottom end surface of the dresser to the rotational center.

FIG. 19 is a graph showing still another example of simulation results of the relationship between the damping ratio ζ of the tilting motion of the displacement portion which tilts about the rotational center CP, and the distance h from the bottom end surface of the dresser 7 to the rotational center CP. In the simulations whose results are shown in FIG. 19, the damping coefficient C around the rotational center CP was set to 0. In the simulations whose results are shown in FIG. 19, simulation conditions, except for the damping coefficient C around the rotational center CP, were identical to those of the simulations whose results are shown in FIG. 17.

Figure 20:
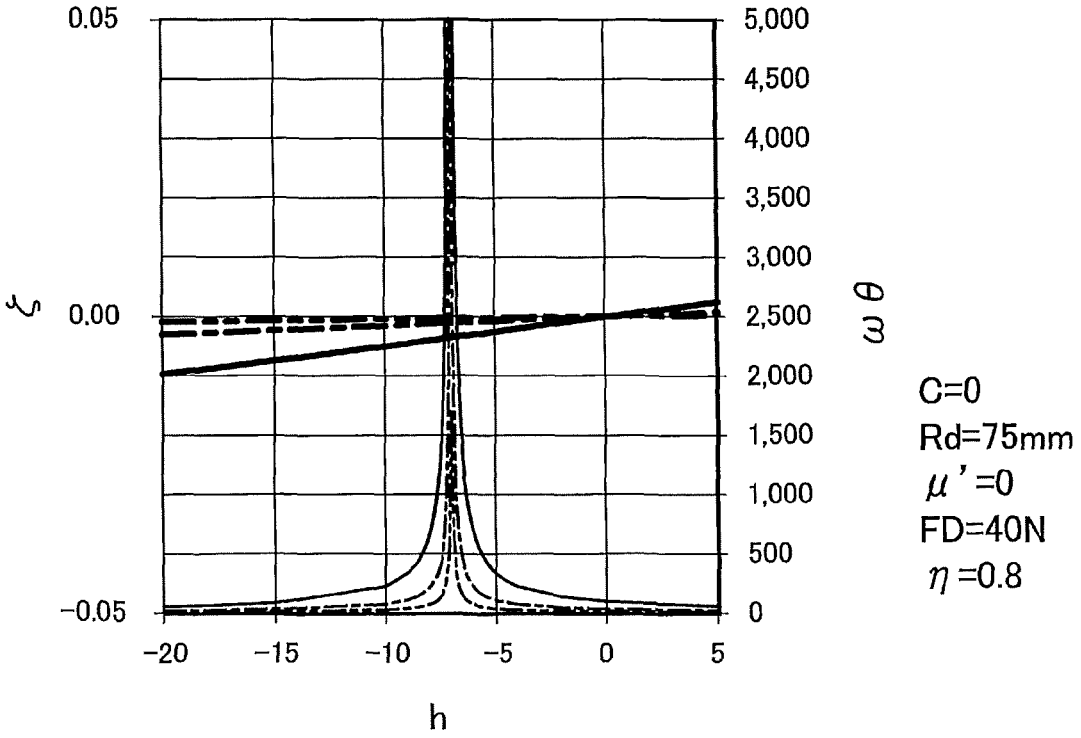
FIG. 20 is a graph showing still another example of simulation results of the relationship between the damping ratio $\zeta$ of the tilting motion of the displacement portion which tilts about the rotational center and the distance h from the bottom end surface of the dresser to the rotational center.

FIG. 20 is a graph showing still another example of simulation results of the relationship between the damping ratio ζ of the tilting motion of the displacement portion which tilts about the rotational center CP, and the distance h from the bottom end surface of the dresser 7 to the rotational center CP. In the simulations whose results are shown in FIG. 20, the damping coefficient C around the rotational center CP was set to 0. In the simulations whose results are shown in FIG. 20, simulation conditions, except for the damping coefficient C around the rotational center CP, were identical to those of the simulations whose results are shown in FIG. 18.

As shown in FIG. 19 and FIG. 20, when the distance h is larger than 0, the damping ratio ζ is a positive number even when the damping coefficient C around the rotational center CP is 0. Therefore, when the rotational center CP is located below the bottom end surface of the dresser 7, the flutter or vibration of the dresser 7 can be prevented regardless of the radius Rd of the dresser 7.

FIGS. 15 through 20 illustrate the simulation results when the value of μ' was set to 0. Simulation results in a case where the value of μ' is negative will be described below. As described above, when the value of μ' is negative, the flutter or vibration of the dresser 7 is likely to occur.

The damping ratio ζ is expressed by the above-described expression (17). Assuming that the value of the damping coefficient C around the rotational center CP is 0, the following expression (18) is an expression for satisfying a condition that the damping ratio ζ, represented by the expression (17), is positive.

$$(\mu' \cdot FD \cdot h^2 + \eta \cdot FD \cdot \mathrm{Rd} \cdot h) > 0$$

$$(\mu' \cdot h + \eta \cdot \mathrm{Rd}) \cdot FD \cdot h > 0 \qquad (18)$$

Assuming that the distance h is a positive number in the expression (18), the following expression (19) is an expression for satisfying a condition that the damping ratio ζ is positive.

$$(\mu' \cdot h + \eta \cdot Rd) > 0 \quad (19)$$

The expression (19) leads to the following expression (20).

$$\mu' > (-\eta \cdot Rd)/h \quad (20)$$

From the expression (20), μ'cri, which is a lower limit (critical value) of μ' that makes the damping ratio ζ positive, is defined by the following expression (21).

$$\mu'cri = (-\eta \cdot Rd)/h \quad (21)$$

When the value of μ' is smaller than the critical value μ' cri, the damping ratio ζ becomes negative, and when the value of μ' is larger than the critical value μ' cri, the damping ratio ζ becomes positive. Specifically, when the value of μ' is smaller than the critical value μ' cri, the flutter or vibration of the dresser 7 occurs.

Figure 21:
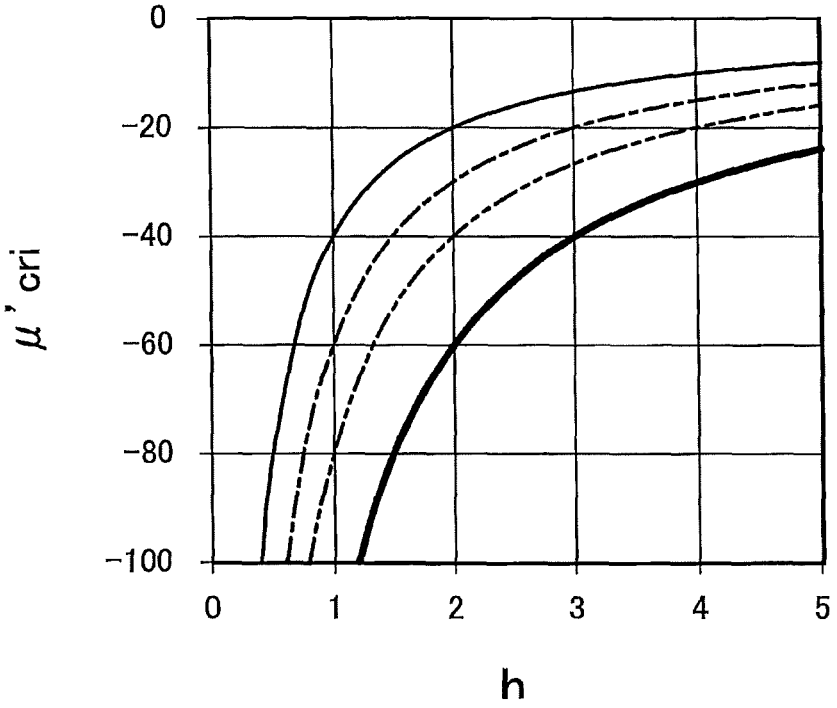
FIG. 21 is a graph showing simulation results of a relationship between a critical value $\mu'$ cri and the distance h from the bottom end surface of the dresser to the rotational center CP.

Based on the expression (21), a relationship between the critical value μ'cri and the distance h from the bottom end surface of the dresser (rotating body) 7 to the rotational center CP was simulated. FIG. 21 is a graph showing simulation results of the relationship between the critical value μ'cri and the distance h from the bottom end surface of the dresser 7 to the rotational center CP. In FIG. 21, a vertical axis represents the critical value μ', and a horizontal axis represents the distance h from the bottom end surface of the dresser 7 to the rotational center CP. In FIG. 21, a thin solid line represents a simulation result in a case where the radius Rd of the dresser 7 is 50 mm, a chain line represents a simulation result in a case where the radius Rd of the dresser 7 is 75 mm, and a two-dot chain line represents a simulation result in a case where the radius Rd of the dresser 7 is 100 mm, and a thick solid line represents a simulation result in a case where the radius Rd of the dresser 7 is 125 mm. In all (i.e., four) simulations whose results are shown in FIG. 21, the value of η was set to 0.8.

As shown in FIG. 21, in a case where the distance h is constant, as the radius Rd of the dresser 7 becomes larger, the critical value μ'cri becomes smaller. Therefore, when the radius Rd of the dresser 7 is large, the flutter or vibration of the dresser 7 is likely to occur.

Figure 22:
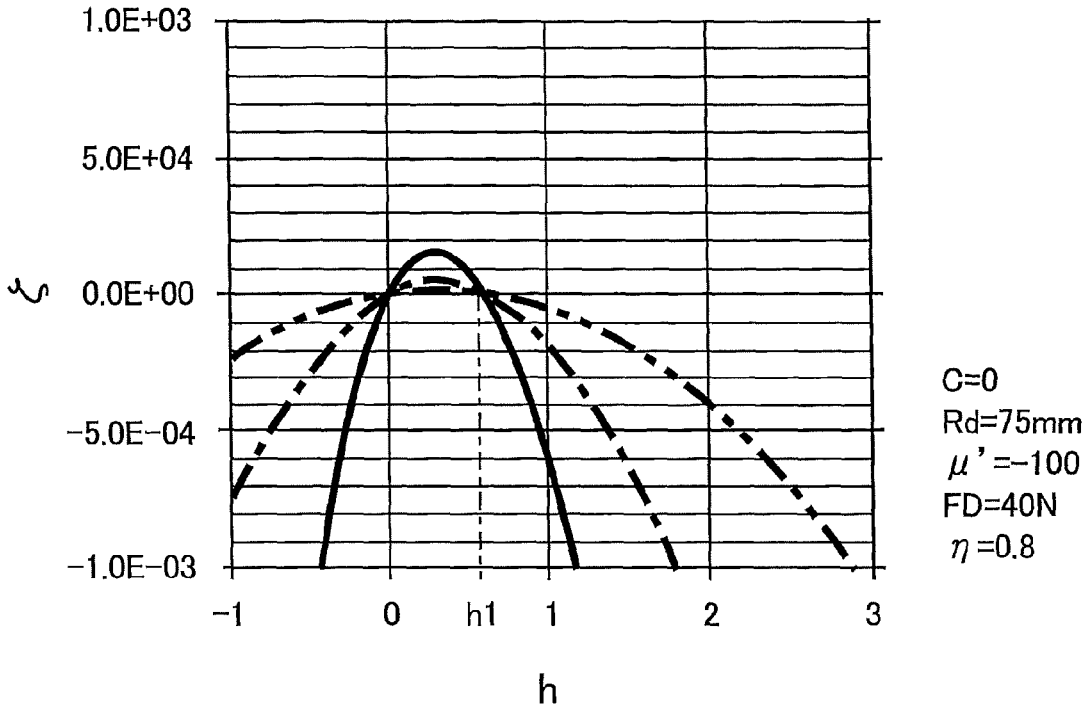
FIG. 22 is a graph showing an example of simulation results of a relationship, when a value of $\mu'$ is negative, between the damping ratio $\zeta$ of the tilting motion of the displacement portion which tilts about the rotational center and the distance h from the bottom end surface of the dresser to the rotational center.
Figure 23:
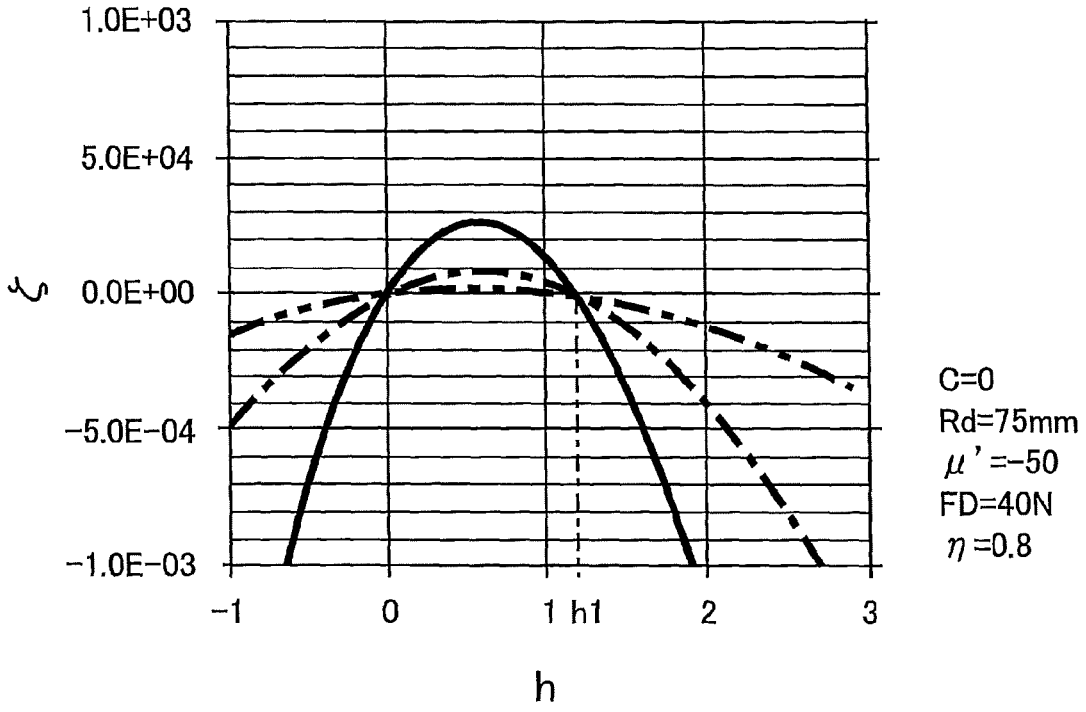
FIG. 23 is a graph showing another example of simulation results of the relationship, when the value of $\mu'$ is negative, between the damping ratio $\zeta$ of the tilting motion of the displacement portion which tilts about the rotational center and the distance h from the bottom end surface of the dresser to the rotational center.

FIG. 22 is a graph showing an example of simulation results of the relationship, when the value of μ' is negative, between the damping ratio ζ of the tilting motion of the displacement portion which tilts about the rotational center CP, and the distance h from the bottom end surface of the dresser 7 to the rotational center CP. FIG. 23 is a graph showing another example of simulation results of the relationship, when the value of μ' is negative, between the damping ratio ζ of the tilting motion of the displacement portion which tilts about the rotational center CP, and the distance h from the bottom end surface of the dresser 7 to the rotational center CP. Simulations whose results are shown in FIG. 22 and FIG. 23 were performed based on the expression (17). In the simulations whose results are shown in FIG. 22, the value of μ' was set to −100. In the simulations whose results are shown in FIG. 23, the value of μ' was set to −50. In the simulations whose results are shown in FIG. 22 and FIG. 23, simulation conditions, except for the value of μ', were identical to those of simulations whose results are shown in FIG. 20.

In FIG. 22 and FIG. 23, a solid line represents a simulation result of the damping ratio ζ in a case where ΣK (=Kθ+Kpad), which is a sum of Kθ and Kpad, is 4000, a chain line represents a simulation result of the damping ratio ζ in a case where ΣK is 40000, and a two-dot chain line represents a simulation result of the damping ratio ζ in a case where ΣK is 400000.

As shown in FIG. 22 and FIG. 23, the simulation results of the damping ratio ζ describe a quadratic curve which projects upwardly. In this quadratic curve, the damping ratio ζ is 0 when the distance h is 0 or equal to h1. Therefore, when the distance h from the bottom end surface of the dresser 7 to the rotational center CP lies between 0 and h1, the damping ratio ζ is a positive number, and when the distance h is smaller than 0 or larger than h1, the damping ratio ζ is a negative number.

As is clear from a comparison between FIG. 22 and FIG. 23, when the value of μ' is more negative, a peak of the damping ratio ζ becomes smaller. Further, when the value of μ' is more negative, the distance h1 becomes smaller. Therefore, as the value of μ' becomes more negative, a range of the distance h that does not cause the flutter or vibration of the dresser 7 becomes narrower.

Figure 24:
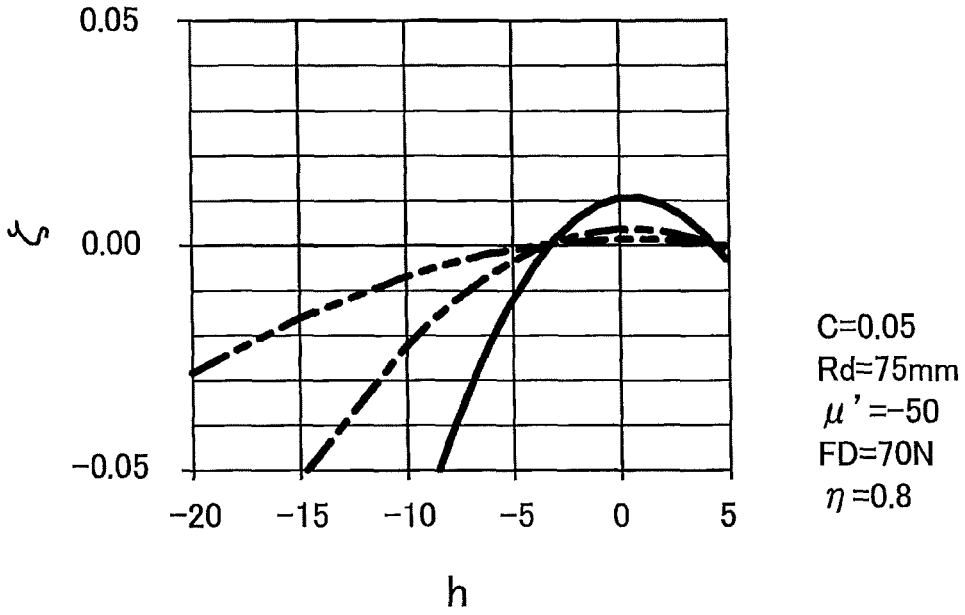
FIG. 24 is a graph showing still another example of simulation results of the relationship, when the value of μ' is negative, between the damping ratio ζ of the tilting motion of the displacement portion which tilts about the rotational center and the distance h from the bottom end surface of the dresser to the rotational center.
Figure 25:
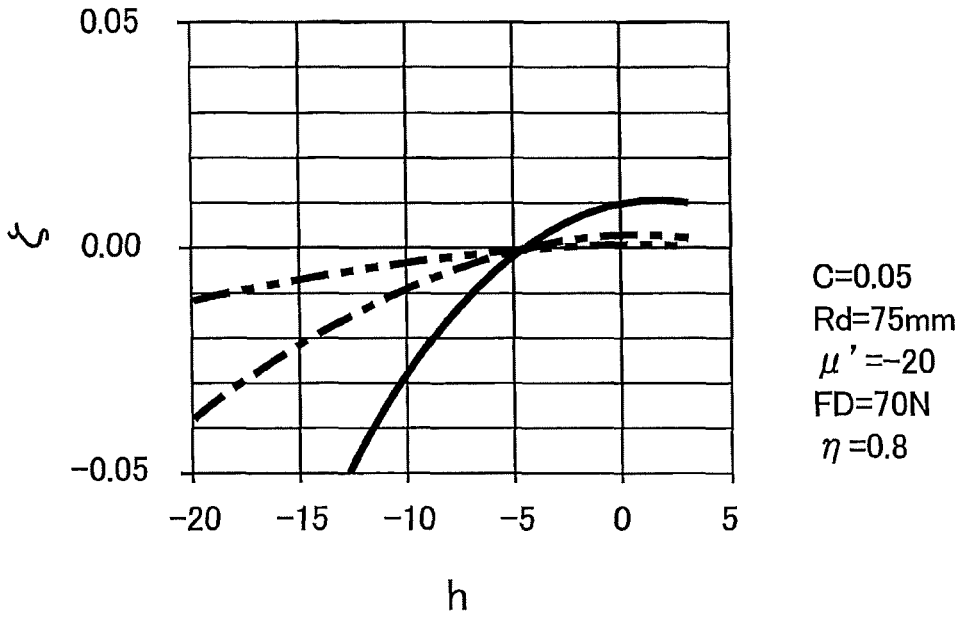
FIG. 25 is a graph showing still another example of simulation results of the relationship, when the value of μ' is negative, between the damping ratio ζ of the tilting motion of the displacement portion which tilts about the rotational center and the distance h from the bottom end surface of the dresser to the rotational center.

As is clear from the expression (17) and the simulation results shown in FIGS. 13 through 18, when the damping coefficient C around the rotational center CP is a positive number, the quadratic curves shown in FIG. 22 shift toward a left side of FIG. 22. Similarly, when the damping coefficient C around the rotational center CP is a positive number, the quadratic curves shown in FIG. 23 shift toward a left side of FIG. 23. FIG. 24 and FIG. 25 are graphs each showing still another embodiment of simulation results of the relationship, when the value of μ' is negative, between the damping ratio ζ of the tilting motion of the displacement portion which tilts about the rotational center CP, and the distance h from the bottom end surface of the dresser 7 to the rotational center CP. In the simulations whose results are shown in FIG. 24, simulation conditions, except that the damping coefficient C around the rotational center CP was 0.05 and the pressing load FD of the dresser 7 was 70 N, were identical to those of the simulation conditions of the simulations whose results are shown in FIG. 23. Further, in the simulations whose results are shown in FIG. 25, simulation conditions, except that the value of μ' was −20, were identical to those of the simulations whose results are shown in FIG. 24.

As shown in FIG. 24 and FIG. 25, the distance h, indicating the position of the rotational center CP that does not cause the flutter or vibration of the dresser 7, may be a negative number. More specifically, the rotational center CP may be located above the bottom end surface of the dresser 7, so long as the damping ratio ζ represented by the expression (17) is not a negative number.

As is clear from FIGS. 13 through 20 and FIGS. 22 through 25, when comparing the damping ratios ζ at the same distance h, the value of the damping ratio ζ increases with the decrease in ΣK which is the sum of Kθ and Kpad. Therefore, in order not to cause the flutter or vibration of the dresser 7, it is preferable that the value of Kθ, which is the tilting stiffness around the rotational center CP, be small. However, in relation to the responsiveness of the tilting motion of the dresser 7 for the undulation of the polishing pad 10*a* of the polishing pad 10, it is preferable that the value of Kθ, which is the tilting stiffness around the rotational center CP, be large. The value of Kθ may be selected depending on intended purpose and/or application.

Figure 26:
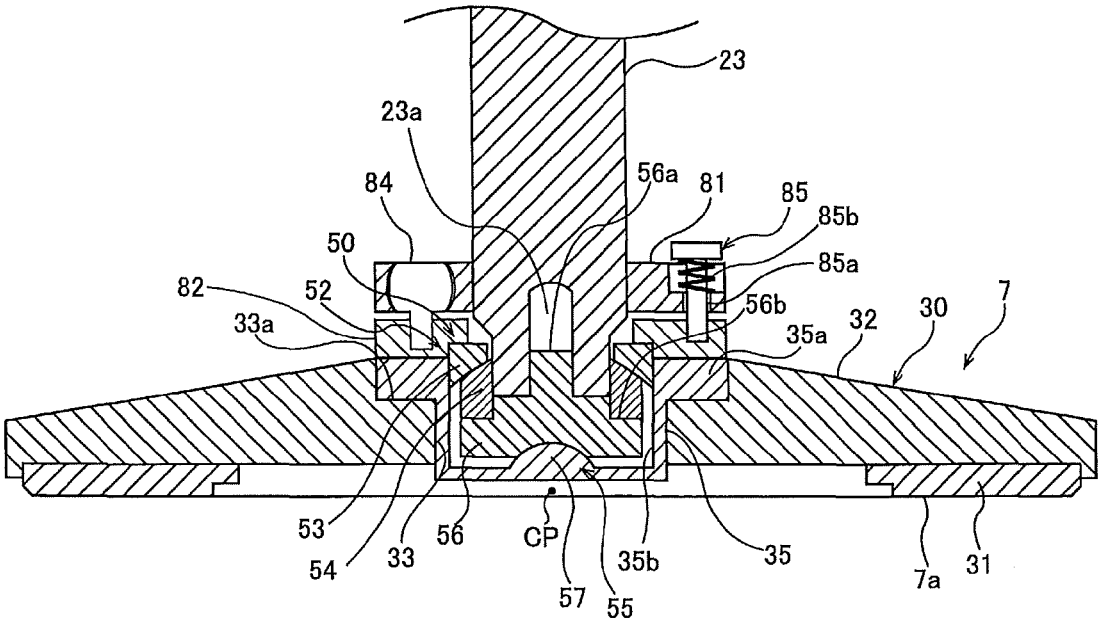
FIG. 26 is a schematic cross-sectional view showing an example of a dressing apparatus in which a torque is transmitted to a dresser through a plurality of torque transmission pins, instead of a bellows.

FIG. 26 is a schematic cross-sectional view showing an example of the dressing apparatus in which a torque is transmitted to the dresser 7 through a plurality of torque transmission pins, instead of the bellows 44. In the embodiment shown in FIG. 26, an annular upper flange 81, an annular lower flange 82, a plurality of torque transmission pins 84, and a plurality of spring mechanisms 85 are provided, instead of the bellows 44, the upper cylindrical portion 45, and the lower cylindrical portion 46 which are shown in FIG. 2. Structures of this embodiment, which will not be described particularly, are identical to those of the embodiment shown in FIG. 2, and their repetitive explanations are omitted.

The upper flange 81 has the same diameter as a diameter of the lower flange 82. The upper flange 81 is fixed to the dresser shaft 23. A small clearance is formed between the upper flange 81 and the lower flange 82. The upper flange 81 and the lower flange 82 may be made of metal, such as stainless steel.

The lower flange 82 is secured to the upper surface of the sleeve 35 of the dresser 7, and is coupled to the dresser 7. The first sliding-contact member 53 of the upper spherical bearing 52 is sandwiched between the lower flange 82 and the second sliding-contact member 54. Further, the upper flange 81 and the lower flange 82 are coupled to each other through the plurality of torque transmission pins (torque transmission members) 84. These torque transmission pins 84 are arranged around the upper flange 81 and the lower flange 82 (i.e., around the central axis of the dresser shaft 23) at equal intervals. The torque transmission pins 84 transmit the torque of the dresser shaft 23 to the dresser 7, while permitting the tiling movement of the dresser 7 with respect to the dresser shaft 23.

Each torque transmission pin 84 has a spherical sliding surface. This sliding surface loosely engages with a receiving hole formed in the upper flange 81. A slight clearance is formed between the sliding surface of the torque transmission pin 84 and the receiving hole of the upper flange 81. When the lower flange 82 and the dresser 7, coupled to the lower flange 82, tilt with respect to the upper flange 81 through the upper spherical bearing 52 and the lower spherical bearing 55, the torque transmission pins 84 also tilt together with the lower flange 82 and the dresser 7, while maintaining the engagement with the upper flange 81.

The torque transmission pins 84 transmit the torque of the dresser shaft 23 to the lower flange 82 and the dresser 7. With the above-described configurations, the dresser 7 and the lower flange 82 are tiltable around the rotational center CP of the upper spherical bearing 52 and the lower spherical bearing 55, and the torque of the dresser shaft 23 can be transmitted to the dresser 7 through the torque transmission pins 84 without restricting the tilting motion.

Further, the upper flange 81 and the lower flange 82 are coupled to each other by the plurality of spring mechanisms 85. These spring mechanisms 85 are arranged around the upper flange 81 and the lower flange 82 (i.e., around the central axis of the dresser shaft 23) at equal intervals. Each spring mechanism 85 has a rod 85*a* which is secured to the lower flange 82 and extends through the upper flange 81, and a spring 85*b* which is disposed between an upper surface of the upper flange 81 and a flange portion formed at an upper end of the rod 85*a*. The spring mechanisms 85 generate a force against the tilting motions of the dresser 7 and the lower flange 82 to recover the dresser 7 to its original position (attitude).

In the embodiment shown in FIG. 2, the bellows 44, which couples the dresser shaft 23 and the dresser 7 to each other, receives the torque of the dresser shaft 23, while deforming in accordance with the tilting motion of the dresser 7. Therefore, it is necessary for the bellows 44 to have a certain degree of stiffness, and as a result, the tilting stiffness Kθ around the rotational center CP cannot be lowered. In contrast, in the embodiment shown in FIG. 26, the tilting stiffness Kθ, when the displacement portion (which is the dresser 7 and the lower flange 82 in this embodiment) tilts around the rotational center CP, can be changed depending on a spring constant of the spring 85*b*, because the torque transmission pins 84 transmit the torque of the dresser shaft 23 to the dresser 7. Therefore, the tilting stiffness Kθ around the rotational center CP can be set arbitrarily, and as a result, the tilting stiffness Kθ around the rotational center CP can be lowered.

Next, a method of determining a maximum pressing load FDmax of the dresser (rotating body) 7, which is tiltably coupled to the dresser shaft (driving shaft) 23 through the coupling mechanism 50 including the upper spherical bearing 52 and the lower spherical bearing 55 that have the same rotational center CP, will be described.

In the method of determining the maximum pressing load of this embodiment, when the distance h (i.e., the distance from the bottom end surface of the dresser 7 to the rotational center CP) is known, the maximum pressing load FDmax of the dresser (rotating body) 7 that can press the dresser 7 against the polishing surface 10*a* of the polishing pad 10 without causing the flutter or vibration of the dresser 7 is determined.

The method of determining the maximum pressing load of this embodiment specifies the above-described expression (8) that is the equation of motion for the translational motion, and specifies the above-described expression (10) that is the equation of motion for the tilting motion. Further, the above-described expression (9), which is the stability condition expression for the translational motion, is specified from the equation of motion for the translational motion, and the above-described expression (11), which is the stability condition expression for the tilting motion, is specified from the equation of motion for the tilting motion.

Further, from the stability condition expression for the translational motion, the following expression (22) can be obtained.

$$FD>(-Cx)/\mu' \tag{22}$$

From the expression (22), an upper limit (a critical value) FD1 of the pressing load FD, which does not cause the flutter or vibration of the dresser 7 in the translational motion, is represented by the following expression (23).

$$FD1=(-Cx)/\mu' \tag{23}$$

Similarly, from the stability condition expression for the tilting motion, the following expression (24) can be obtained.

$$FD>(-C)/(\mu'\cdot h^2+\eta\cdot \mathrm{Rd}\cdot h) \tag{24}$$

From the expression (24), an upper limit (a critical value) FD2 of the pressing load FD, which does not cause the flutter or vibration of the dresser 7 in the tilting motion, is represented by the following expression (25).

$$FD2=(-C)/(\mu'\cdot h^2+\eta\cdot \mathrm{Rd}\cdot h) \tag{25}$$

The critical value FD1 of the pressing load in the translational motion and the critical value FD2 of the pressing load in the tilting motion may be calculated with use of a value of μ' that is expected from a property of polishing pad 10, or with use of a value of μ' that is obtained from the Stribeck curve. In either case, the largest negative number, which has been expected or obtained, is preferably used as the value of μ'. The damping coefficient Cx in the translational motion is set to a predetermined value which has been obtained from experiments or the like (for example, Cx is assumed to be 0.05). Similarly, the damping coefficient C around the rotational center CP is set to a predetermined value which has been obtained from experiments or the like (for example, C is assumed to be 0.05). Further, the ratio η of the load radius R to the radius Rd of the dresser 7 may be determined from an expected maximum relative velocity V, or may be a predetermined value which has been obtained from experiments or the like (for example, η is assumed to be 0.8). The distance h from the bottom end surface of the dresser 7 to the rotational center CP and the radius Rd of the dresser 7 are known values.

In the method of determining the maximum pressing load of this embodiment, the critical value FD1 of the pressing load in the translational motion is compared with the critical value FD2 of the pressing load in the tilting motion. Further, in the method of determining the maximum pressing load of this embodiment, if the critical value FD1 of the pressing load in the translational motion is smaller than or equal to the critical value FD2 of the pressing load in the tilting motion, the critical value FD1 of the pressing load in the translational motion is determined to be the maximum pressing load FDmax of the dresser 7. If the critical value FD1 of the pressing load in the translational motion is larger than the critical value FD2 of the pressing load in the tilting motion, the critical value FD2 of the pressing load in the tilting motion is determined to be the maximum pressing load FDmax of the dresser 7. If necessary, the smaller one of the critical values may be multiplied by a predetermined safety factor (e.g., 0.8), and a resultant value of the pressing load may be determined to be the maximum pressing load FDmax.

Figure 27:
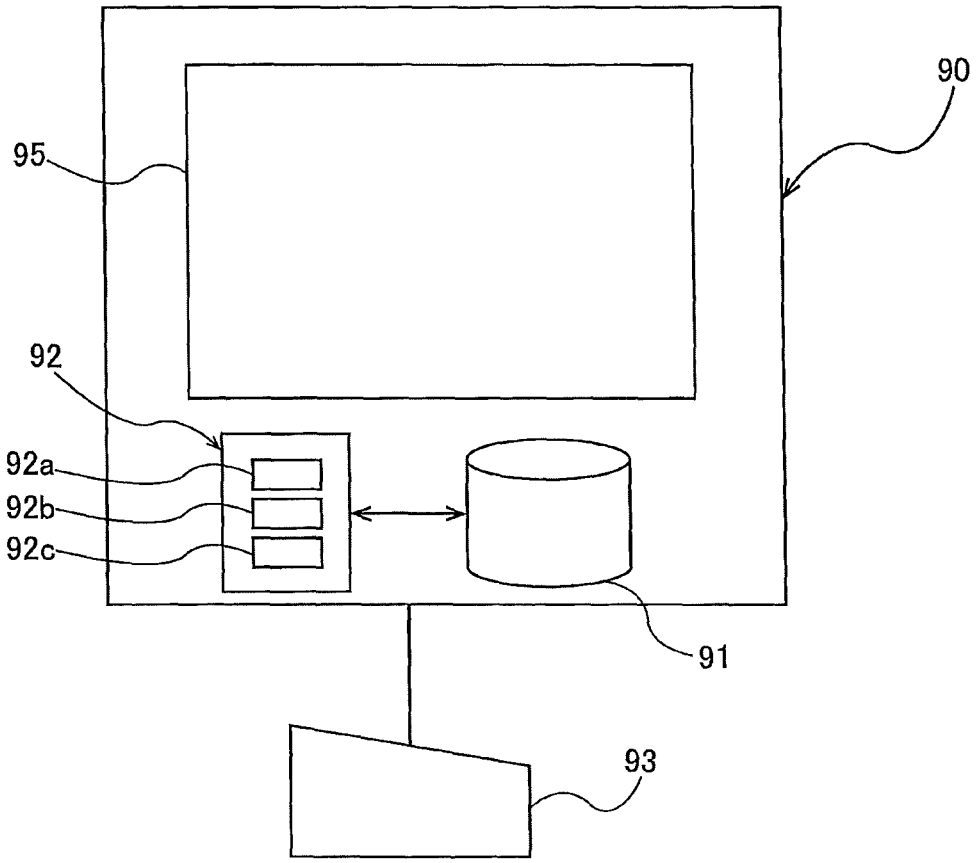
FIG. 27 is a schematic view showing an example of a computer for performing a program of determining a position of a rotational center.

Next, a program of determining the position of the rotational center for performing the above-described method of determining the position of the rotational center will be described. FIG. 27 is a schematic view showing an example of a computer 90 for performing the program of determining the position of the rotational center. As shown in FIG. 27, the computer 90 includes a storage device 91, such as a hard disk drive, for storing therein the program of determining the position of the rotational center, an arithmetic device 92 for processing the program of determining the position of the rotational center, and an input device 93, such as a keyboard, for inputting necessary information for performing the program of determining the position of the rotational center. The arithmetic device 92 includes CPU (Central Processing Unit) 92*a*, ROM (Read Only Memory) 92*b*, and RAM (Random Access Memory) 92*c*, and is configured to calculate the range of the position of the rotational center CP based on the program of determining the position of the rotational center which has been stored in the storage 91. The range of the position of the rotational center CP, calculated by the arithmetic device 92, is displayed on a display device 95 which is installed on the computer 90.

The program of determining the position of the rotational center, which is performed by the computer 90, may be stored into the storage device 91 from a recording medium which can be read by the computer 90, or may be stored into the storage device 91 through a communication network, such as the Internet. Examples of the computer-readable recording medium include a CD-ROM (Compact Disk Read Only Memory), a DVD (Digital Versatile Disk), an MO (Magneto Optical Disk), and a memory card.

Figure 28:
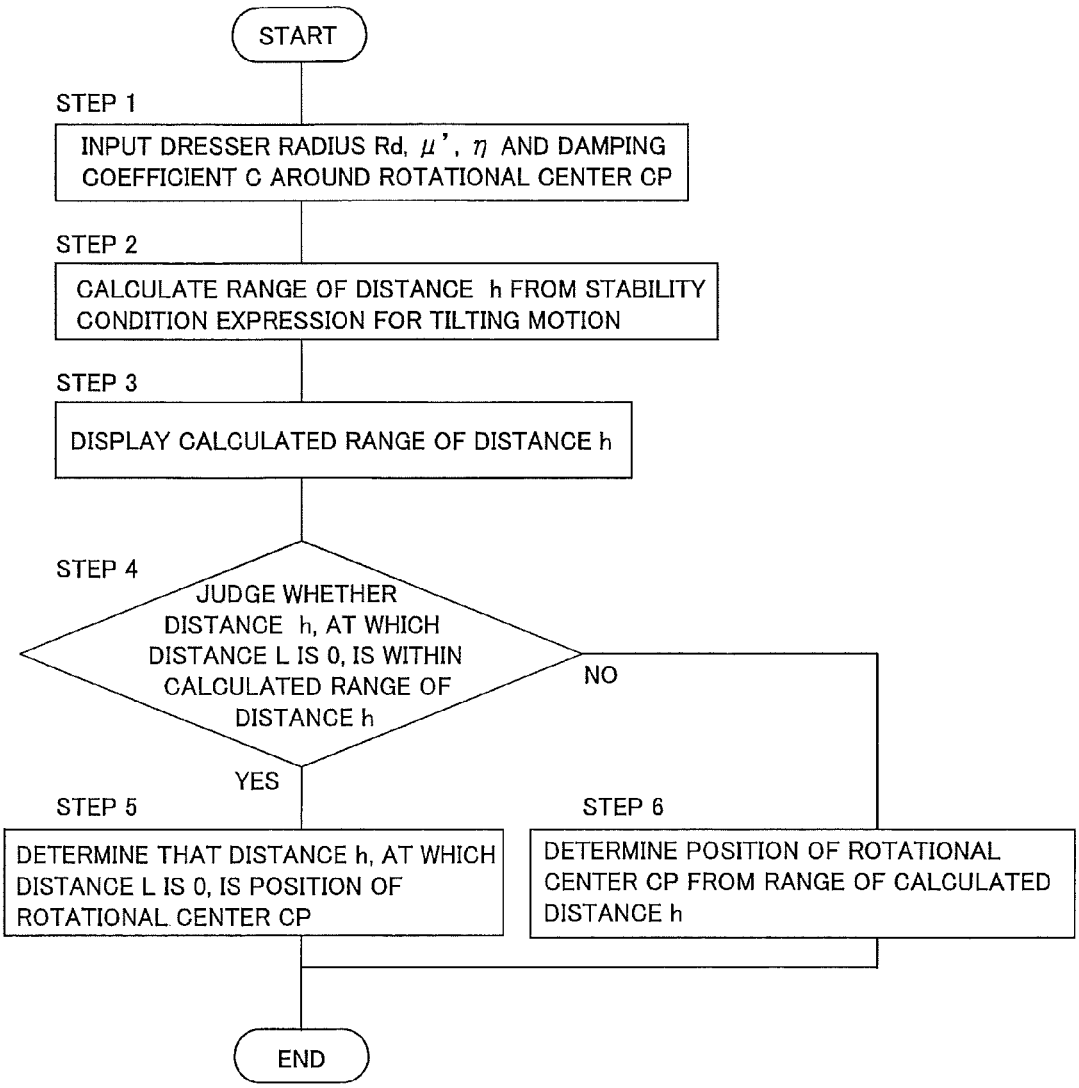
FIG. 28 is a flowchart showing a sequence of operations for determining a rotational center of the coupling mechanism shown in FIG. 2, based on a program of determining a position of the rotational center according to an embodiment.

FIG. 28 is a flowchart showing a sequence of operations for determining the rotational center CP of the coupling mechanism 50 shown in FIG. 2, based on the program of determining the position of the rotational center according to an embodiment. The program of determining the position of the rotational center according to this embodiment includes a program which calculates the range of the distance h (i.e., the range of the position of the rotational center CP) shown by the expression (12) from the stability condition expression (11) that has been specified based on the above-described equation of motion (10) for the tilting motion. More specifically, the program of determining the position of the rotational center CP includes the program which calculates the range of the distance h from the bottom end surface of the dresser 7 to the rotational center CP based on the expression (12).

In order to enable the computer 90 to determine the position of the rotational center CP, the radius Rd of the dresser 7, the value of μ', the value of η, and the damping coefficient C around the rotational center CP are first input into the computer 90 from the input device 93 of the computer 90 (step 1). The value of μ' to be input into the computer 90 may be a value of μ' which is expected from a property of the polishing pad 10, or may be a value of μ' which is obtained from the Stribeck curve. In either case, the largest negative number, which has been expected or obtained, is preferably used as the value of μ'. The pressing load FD may preferably be a maximum pressing load used in a dressing process. Further, the value of η to be input into the computer 90 may be determined from an expected maximum relative velocity V, or may be a predetermined value which has been obtained from experiments or the like. For example, the value of η as the predetermined value to be input into the computer 90 is assumed to be 0.8. The damping coefficient C that has been set to a predetermined value is input into the computer 90. For example, the damping coefficient C around the rotational center CP is assumed to be 0.05.

Next, the computer 90 calculates the range of the distance h from the bottom end surface of the dresser 7 to the rotational center CP from the above-described expression (12), based on the program of determining the position of the rotational center (step 2), and then displays this range of the distance h on the display device 95 (step 3). The range of the distance h calculated in the step 2 indicates a range of the position of the rotational center CP which can prevent the flutter or vibration of the dresser 7.

The program of determining the position of the rotational center according to this embodiment further includes a program for considering the responsiveness of the dresser 7 for the undulation of the polishing pad 10*a*. More specifically, the program of determining the position of the rotational center includes a program that judges whether or not the distance h, at which the distance L between the center of inertia G of the displacement portion and the rotational center CP is 0, falls within the range of the distance h calculated in the step 2. Therefore, with use of the program of determining the position of the rotational center, the computer 90 judges whether or not the distance h, at which the distance L is 0, falls within the range of the distance h calculated in the step 2 (step 4). The center of inertia G of the displacement portion can be calculated in advance from the shape and material of the dresser 7 and the shape and material of the lower cylindrical portion 46. Alternatively, the program of determining the position of the rotational center may include a program that calculates the center of inertia G of the displacement portion from the shape and material of the dresser 7 and the shape and material of the lower cylindrical portion 46.

If the distance h, at which the distance L is 0, falls within the range of the distance h calculated in the step 2, the computer 90 determines that the distance h, at which the distance L is 0, is the position of the rotational center CP, based on the program of determining the position of the rotational center (step 5). If the distance h, at which the distance L is 0, is out of the range of the distance h calculated in the step 2, the computer 90 determines the position of the rotational center CP which falls within the range of the distance h displayed on the display device 95 in the step 3 (step 6).

In the step 6 for determining the position of the rotational center CP, the computer 90 may determine the position of the rotational center CP which is located on the bottom end surface of the dresser 7. As described above, when the rotational center CP is located on the bottom end surface of the dresser 7 (i.e., the distance h is 0), the stability condition expression (11) for the tilting motion can be satisfied regardless of the pressing load FD of the dresser, 7 the radius Rd of the dresser 7, and the value of μ'.

The program of determining the position of the rotational center may not include the program for considering the responsiveness of the dresser 7 for the undulation of the polishing pad 10*a*. More specifically, the computer 90 may determine the position of the rotational center CP that falls within the range of the distance h displayed on the display device 95 in the step 3. In this case, the computer 90 may determine the position of the rotational center CP that is located on the bottom end surface of the dresser 7.

Next, a program of determining the maximum pressing load for performing the above-described method of determining the maximum pressing load, will be described. The program of determining the maximum pressing load according to this embodiment is performed by a computer which has the same construction as that of the computer 90 shown in FIG. 27. The program of determining the maximum pressing load which is performed by the computer 90 may be stored into the storage device 91 from a recording medium which can be read by the computer 90, or may be stored into the storage device 91 through a communication network, such as the Internet. Examples of the computer-readable recording medium include a CD-ROM (Compact Disk Read Only Memory), a DVD (Digital Versatile Disk), an MO (Magneto Optical Disk), and a memory card.

Figure 29:
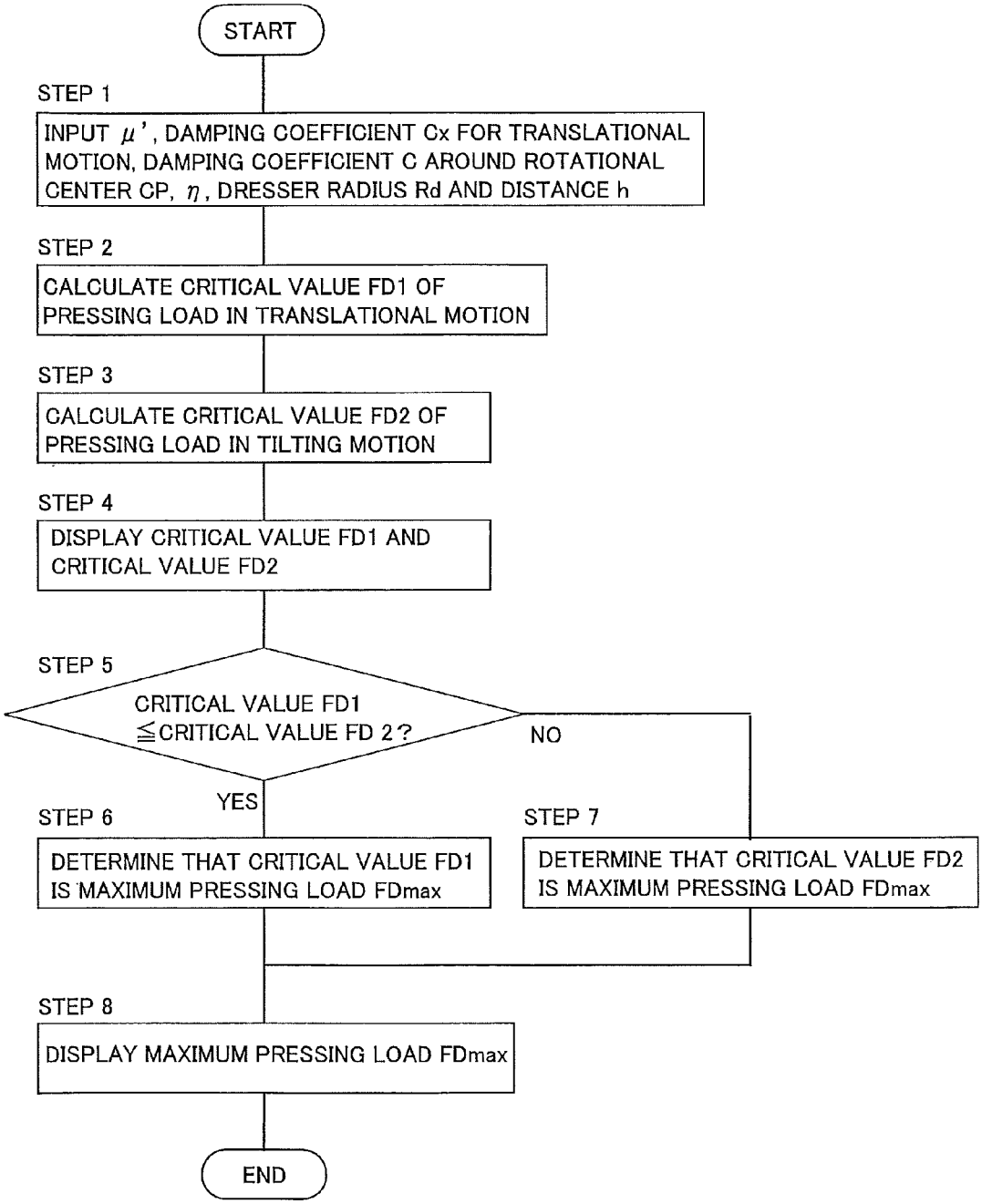
FIG. 29 is a flowchart showing a sequence of operations for determining a maximum pressing load of the dresser shown in FIG. 2, based on a program of determining a maximum pressing load of the dresser according to an embodiment.

FIG. 29 is a flowchart showing a sequence of operations for determining the maximum pressing load FDmax of the dresser 7 shown in FIG. 2, based on the program of determining the maximum pressing load according to an embodiment. The program of determining the maximum pressing load according to this embodiment includes a program which calculates the critical value FD1 of the pressing load in the translational motion from the stability condition expression (9) for the translational motion that has been specified based on the above-described equation of motion (8) for the translational motion. Further, the program of determining the maximum pressing load according to this embodiment includes a program which calculates the critical value FD2 of the pressing load in the tilting motion from the stability condition expression (11) for the tilting motion that has been specified based on the above-described equation of motion (10) for the tilting motion. More specifically, the program of determining the maximum pressing load includes the program which calculates the critical value FD1 of the pressing load in the translational motion based on the above-described expression (23), and further includes the program which calculates the critical value FD2 of the pressing load in the tilting motion based on the above-described expression (25).

In order to enable the computer 90 to calculate the critical value FD1 of the pressing load in the translational motion and to calculate the critical value FD2 of the pressing load in the tilting motion, the value of μ', the damping coefficient Cx in the translational motion, the damping coefficient C around the rotational center CP, the ratio η of the load radius R to the radius R of the dresser 7, the radius Rd of the dresser 7, and the distance h from the bottom end surface of the dresser 7 to the rotational center CP are first input into the computer 90 from the input device 93 of the computer 90 (step 1).

The value of μ' to be input into the computer 90 may be a value of μ' which is expected from a property of polishing pad 10, or may be a value of μ' which is obtained from the Stribeck curve. In either case, the largest negative number, which has been expected or obtained, is preferably used as the value of μ'. The damping coefficient Cx in the translational motion is set to a predetermined value which has been obtained from experiments or the like (for example, Cx is assumed to be 0.05). Similarly, the damping coefficient C around the rotational center CP is set to a predetermined value which has been obtained from experiments or the like (for example, C is assumed to be 0.05). Further, the ratio η of the load radius R to the radius Rd of the dresser 7 may be determined from an expected maximum relative velocity V, or may be a predetermined value which has been obtained from experiments or the like (for example, η is assumed to be 0.8). The distance h from the bottom end surface of the dresser 7 to the rotational center CP and the radius Rd of the dresser 7 are known values.

Next, the computer 90 calculates, based on the program of determining the maximum pressing load, the critical value FD1 of the pressing load in the translational motion from the above-described expression (23) (step 2), and further calculates the critical value FD2 of the pressing load in the tilting motion from the above-described expression (25) (step 3). Further, the computer 90 displays, based on the program of determining the maximum pressing load, the calculated critical value FD1 and the calculated critical value FD2 on the display device 95 (step 4).

Next, the computer 90 compares, based on the program of determining the maximum pressing load, the critical value FD1 of the pressing load in the translational motion with the critical value FD2 of the pressing load in the tilting motion. More specifically, the computer 90 judges whether or not the critical value FD1 of the pressing load in the translational motion is smaller than or equal to the critical value FD2 of the pressing load in the tilting motion (step 5). If the critical value FD1 of the pressing load in the translational motion is smaller than or equal to the critical value FD2 of the pressing load in the tilting motion, the computer 90 determines that the critical value FD1 of the pressing load in the translational motion is the maximum pressing load FDmax, based on the program of determining the maximum pressing load (step 6). If the critical value FD1 of the pressing load in the translational motion is larger than the critical value FD2 of the pressing load in the tilting motion, the computer 90 determines that the critical value FD1 of the pressing load in the tilting motion is the maximum pressing load FDmax (step 7). Further, the computer 90 displays the maximum pressing load FDmax on the display device 95 (step 8).

Although not shown, the computer 90 may multiply the smaller one of the critical values by a predetermined safety factor (e.g., 0.8) and may determine that a resultant value of the pressing load is the maximum pressing load FDmax, based on the program of determining the maximum pressing load. In this case, the computer 90 preferably displays both of the maximum pressing load FDmax and the safety factor on the display device 95.

Figure 30:
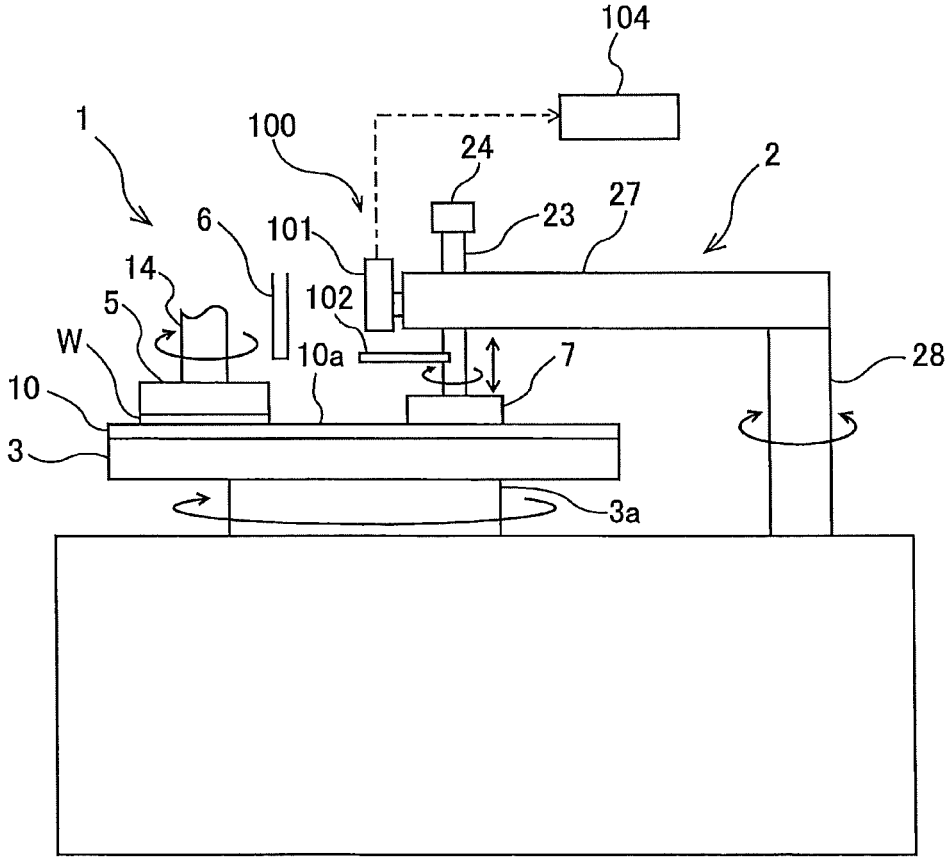
FIG. 30 is a schematic side view showing an example of a substrate polishing apparatus including a dressing apparatus which is provided with a pad-height measuring device for obtaining a profile of a polishing pad.

FIG. 30 is a schematic cross-sectional view showing an example of the substrate polishing apparatus 1 in which a pad-height measuring device 100 for obtaining a profile of the polishing pad 10 is installed in the dressing apparatus 2. Structures of this embodiment, except for the pad-height measuring device 100, are identical to those of the embodiment shown in FIG. 1, and their repetitive explanations are omitted.

The pad-height measuring device 100 shown in FIG. 30 includes a pad-height sensor 101 configured to measure a height of the polishing surface 10*a*, a sensor target 102 opposite the pad-height sensor 40, and a dressing monitoring device 104 to which the pad-height sensor 101 is coupled. The pad-height sensor 101 is secured to the dresser arm 27, and the sensor target 102 is secured to the dresser shaft 23. The sensor target 102 vertically moves together with the dresser shaft 23 and the dresser 7. In contrast, a vertical position of the pad-height sensor 101 is fixed. The pad-height sensor 101 is a displacement sensor, which is configured to measure a displacement of the sensor target 102 to thereby indirectly measure the height of the polishing surface 10*a* (or a thickness of the polishing pad 10). Since the sensor target 102 is coupled to the dresser 7, the pad-height sensor 101 can measure the height of the polishing surface 10*a* during dressing of the polishing pad 10.

The pad-height sensor 101 indirectly measures the polishing surface 10*a* from the vertical position of the dresser 7 when the dresser 7 is in contact with the polishing surface 10*a*. Therefore, an average of heights of the polishing surface 10*a* that is in contact with the lower surface (i.e., the dressing surface) of the dresser 7 is measured by the pad-height sensor 101. The pad-height sensor 101 may comprise any type of sensors, such as a linear scale sensor, a laser sensor, an ultrasonic sensor, and an eddy current sensor.

The pad-height sensor 101 is coupled to the dressing monitoring device 104, and an output signal of the pad-height sensor 101 (i.e., a measured value of the height of the polishing surface 10*a*) is sent to the dressing monitoring device 104. The dressing monitoring device 104 has functions to obtain a profile of the polishing pad 10 (i.e., a cross-sectional shape of the polishing surface 10*a*) from measured values of the height of the polishing surface 10*a* and to determine whether or not the dressing of the polishing pad 10 is performed properly.

If the position of the rotational center CP of the coupling mechanism 50 is determined with use of the above-described method of determining the position of the rotational center and the above-described program of determining the position of the rotational center, no flutter or vibration of the dresser 7 occurs. Similarly, if the maximum pressing load FDmax of the dresser 7 is determined with use of the above-described method of determining the maximum pressing load and the above-described program of determining the maximum pressing load, no flutter or vibration of the dresser 7 occurs. Therefore, an accurate profile of the polishing pad 10 can be obtained when the dresser 7 is dressing the polishing surface 10*a* of the polishing pad 10. As a result, the dressing monitoring device 104 can accurately determine whether or not the dressing of the polishing pad 10 is performed properly.

The above described embodiments of the method of determining the position of the rotational center and the program of determining the position of the rotational center are embodiments for determining the position of the rotational center CP of the coupling mechanism 50 that couples the dresser 7 to the dresser shaft 23. However, the same method of determining the position of the rotational center and the same program of determining the position of the rotational center may be used to determine a position of a rotational center of a coupling mechanism that couples the polishing head 5 to the head shaft 14. Further, the above-described embodiments of the method of determining the maximum pressing load and the program of determining the maximum pressing load are embodiments for determining the maximum pressing load FDmax of the dresser 7. However, the same method of determining the maximum pressing load and the same program of determining the maximum pressing load may be used to determine a maximum pressing load of the polishing head 5.

Although the embodiments according to the present invention have been described above, it should be understood that the present invention is not limited to the above embodiments, and various changes and modifications may be made without departing from the technical concept of the appended claims.

What is claimed is:

1. A coupling mechanism for tiltably coupling a rotating body to a drive shaft, comprising:

an upper spherical bearing and a lower spherical bearing disposed between the drive shaft and the rotating body, wherein the upper spherical bearing includes a first sliding-contact member and a second sliding-contact member which are sandwiched between the drive shaft and the rotating body, the first sliding-contact member has a first concave contact surface, and the second sliding-contact member has a second convex contact surface which is in contact with the first concave contact surface, the lower spherical bearing includes a third sliding-contact member attached to the drive shaft, and a fourth sliding-contact member attached to the rotating body, the third sliding-contact member has a third concave contact surface, and the fourth sliding-contact member has a fourth convex contact surface which is in contact with the third concave contact surface, the first concave contact surface and the second convex contact surface are located above the third concave contact surface and the fourth convex contact surface, and the first concave contact surface, the second convex contact surface, the third concave contact surface, and the fourth convex contact surface are arranged concentrically.

2. The coupling mechanism according to claim 1, wherein each of the first concave contact surface and the second convex contact surface has a shape of a part of an upper half of a spherical surface having a first radius, and each of the third concave contact surface and the fourth convex contact surface has a shape of a part of an upper half of a spherical surface having a second radius which is smaller than the first radius.

3. The coupling mechanism according to claim 1, wherein the upper spherical bearing and the lower spherical bearing have a same rotational center, and the rotational center is located below the first concave contact surface, the second convex contact surface, the third concave contact surface, and the fourth convex contact surface.

4. The coupling mechanism according to claim 3, wherein a distance from a bottom end surface of the rotating body to the rotational center can be changed by selecting radii of curvature of the first concave contact surface, the second convex contact surface, the third concave contact surface, and the fourth convex contact surface.

5. The coupling mechanism according to claim 3, wherein the rotational center is located on a bottom end surface of the rotating body.

6. The coupling mechanism according to claim 3, wherein the rotational center coincides with a center of inertia of a displacement portion which can tilt about the rotational center.

7. The coupling mechanism according to claim 3, wherein the rotational center is located between a bottom end surface of the rotating body and a center of inertia of a displacement portion which can tilt about the rotational center.

8. The coupling mechanism according to claim 3, wherein the rotational center is located below a bottom end surface of the rotating body.

9. The coupling mechanism according to claim 1, wherein one of the first sliding-contact member and the second sliding-contact member has a Young's modulus which is equal to or lower than a Young's modulus of the other, or has a damping coefficient which is higher than a damping coefficient of the other.

10. A substrate polishing apparatus comprising:

a polishing table for supporting a polishing pad; and a polishing head configured to press a substrate against the polishing pad, wherein the polishing head is coupled to a drive shaft through the coupling mechanism according to claim 1.

11. A substrate polishing apparatus comprising:

a polishing table for supporting a polishing pad;

a polishing head configured to press a substrate against the polishing pad; and a dresser which is pressed against the polishing pad, wherein the dresser is coupled to a drive shaft through the coupling mechanism according to claim 1.

12. The substrate polishing apparatus according to claim 11, further comprising:

a pad-height measuring device configured to measure a height of a polishing surface of the polishing pad, wherein the pad-height measuring device includes:

a pad-height sensor secured to a dresser arm which rotatably supports the drive shaft; and a sensor target secured to the drive shaft.

13. A method of determining a position of a rotational center of a coupling mechanism which includes an upper spherical bearing and a lower spherical bearing having a same rotational center and tiltably couples a rotating body to a drive shaft, comprising:

specifying an equation of motion for a tilting motion of a displacement portion which can tilt about the rotational center when the rotating body is in sliding contact with a polishing pad supported by a rotating polishing table, while rotating the rotating body;

specifying a stability condition expression for the tilting motion for preventing flutter or vibration of the rotating body, based on the equation of motion for the tilting motion;

calculating a range of a position of the rotational center for preventing the flutter or vibration of the rotating body, based on the stability condition expression for the tilting motion; and determining the position of the rotational center which falls within the calculated range.

14. The method of determining the position of the rotational center according to claim 13, wherein said determining comprises, if a center of inertia of the displacement portion falls within the calculated range, determining the position of the rotational center which coincides with the center of inertia.

15. A non-transitory computer-readable storage medium storing a program of determining a position of a rotational center of a coupling mechanism which includes an upper spherical bearing and a lower spherical bearing having a same rotational center and tiltably couples a rotating body to a drive shaft, the program causing a computer to perform operations of:

calculating a range of the position of the rotational center for preventing flutter or vibration of the rotating body, from a stability condition expression for a tilting motion, which is specified based on an equation of motion for the tilting motion of a displacement portion which can tilt about the rotational center when the rotating body is in sliding contact with a polishing pad supported by a rotating polishing table, while rotating the rotating body; and determining the position of the rotational center which falls within the calculated range.

16. The non-transitory computer-readable storage medium storing the program of determining the position of the rotational center according to claim 15, wherein causing the computer to perform an operation of said determining comprises causing the computer to perform an operation of, if a center of inertia of the displacement portion falls within the calculated range, determining the position of the rotational center which coincides with the center of inertia.

17. A method of determining a maximum pressing force of a rotating body which is tiltably coupled to a drive shaft through a coupling mechanism which includes an upper spherical bearing and a lower spherical bearing having a same rotational center, comprising:

specifying an equation of motion for a translational motion and an equation of motion for a tilting motion of a displacement portion which can tilt about the rotational center when the rotating body is in sliding contact with a polishing pad supported by a rotating polishing table, while rotating the rotating body;

specifying a stability condition expression for the translational motion for preventing flutter or vibration of the rotating body, based on the equation of motion for the translational motion;

specifying a stability condition expression for the tilting motion for preventing flutter or vibration of the rotating body, based on the equation of motion for the tilting motion;

calculating a critical value of a pressing load in the translational motion, based on the stability condition expression for the translational motion;

calculating a critical value of a pressing load in the tilting motion, based on the stability condition expression for the tilting motion;

comparing the critical value of the pressing load in the translational motion with the critical value of the pressing load in the tilting motion;

if the critical value of the pressing load in the translational motion is smaller than or equal to the critical value of the pressing load in the tilting motion, determining that the critical value of the pressing load in the translational motion is the maximum pressing load of the rotating body; and if the critical value of the pressing load in the translational motion is larger than the critical value of the pressing load in the tilting motion, determining that the critical value of the pressing load in the tilting motion is the maximum pressing load of the rotating body.

18. A non-transitory computer-readable storage medium storing a program of determining a maximum pressing load of a rotating body which is tiltably coupled to a drive shaft through a coupling mechanism which includes an upper spherical bearing and a lower spherical bearing having a same rotational center, the program causing a computer to perform operations of:

calculating a critical value of a pressing load in a translational motion, which can prevent flutter or vibration of the rotating body, from a stability condition expression for the translational motion which is specified based on an equation of motion for the translational motion of a displacement portion which can tilt about the rotational center when the rotating body is in sliding contact with a polishing pad supported by a rotating polishing table, while rotating the rotating body;

calculating a critical value of a pressing load in a tilting motion, which can prevent flutter or vibration of the rotating body, from a stability condition expression for the tilting motion which is specified based on an equation of motion for the tilting motion of the displacement portion when the rotating body is in sliding contact with the polishing pad supported by the rotating polishing table, while rotating the rotating body;

comparing the critical value of the pressing load in the translational motion with the critical value of the pressing load in the tilting motion;

if the critical value of the pressing load in the translational motion is smaller than or equal to the critical value of the pressing load in the tilting motion, determining that the critical value of the pressing load in the translational motion is the maximum pressing load of the rotating body; and if the critical value of the pressing load in the translational motion is larger than the critical value of the pressing load in the tilting motion, determining that the critical value of the pressing load in the tilting motion is the maximum pressing load of the rotating body.

* * * * *